US007992327B2

(12) United States Patent
Gamble, II et al.

(10) Patent No.: US 7,992,327 B2
(45) Date of Patent: Aug. 9, 2011

(54) SNOW PLOW REBOUND APPARATUS

(75) Inventors: Robert N. Gamble, II, Watertown, WI (US); Mark D. Buckee, Wauwatosa, WI (US)

(73) Assignee: Sno-Way International, Inc., Hartford, WI (US)

( * ) Notice: Subject to any disclaimer, the term of this patent is extended or adjusted under 35 U.S.C. 154(b) by 273 days.

(21) Appl. No.: 12/485,508

(22) Filed: Jun. 16, 2009

(65) Prior Publication Data

US 2009/0307942 A1 Dec. 17, 2009

Related U.S. Application Data

(60) Provisional application No. 61/073,252, filed on Jun. 17, 2008.

(51) Int. Cl.
*E01H 5/04* (2006.01)

(52) U.S. Cl. ..... 37/232

(58) Field of Classification Search ..... 37/231, 37/232, 266–268, 264, 270, 235, 236; 172/811–817, 172/701.3, 726, 810, 272
See application file for complete search history.

(56) References Cited

U.S. PATENT DOCUMENTS

| | | | |
|---|---|---|---|
| 299,472 | A | 5/1884 | Hebert et al. |
| 711,776 | A | 10/1902 | Lieske |
| 766,710 | A | 8/1904 | Lieske |
| 778,625 | A | 12/1904 | Bassett |
| 1,228,462 | A | 6/1917 | Marks |
| 2,256,273 | A | 9/1941 | Begley |
| 2,754,601 | A | 7/1956 | Meyer |
| 3,104,893 | A | 9/1963 | Torrey |
| 3,285,625 | A | 11/1966 | Krueger |
| 3,351,116 | A | 11/1967 | Madsen |
| 3,410,008 | A | 11/1968 | Standfuss |
| 3,477,151 | A | 11/1969 | Zanella |
| 3,651,587 | A | 3/1972 | Plasser et al. |
| 3,851,894 | A | 12/1974 | St. Pierre |
| 3,987,562 | A | 10/1976 | Deen et al. |
| 4,074,448 | A | 2/1978 | Niemela |
| 4,099,578 | A | 7/1978 | Stevens |
| 4,145,825 | A | 3/1979 | Bertolino |
| 4,266,352 | A | 5/1981 | Newman |
| 4,275,514 | A | 6/1981 | Maura |
| 4,304,056 | A | 12/1981 | Watson et al. |
| 4,306,362 | A | 12/1981 | Waterman |
| RE31,045 | E | 10/1982 | Essell et al. |
| 4,356,645 | A | 11/1982 | Hine et al. |
| 4,436,477 | A | 3/1984 | Lenertz et al. |
| 4,479,312 | A | 10/1984 | Turgeon |
| 4,619,060 | A | 10/1986 | Knowlton |
| 4,658,519 | A | 4/1987 | Quenzi |
| 4,723,609 | A | 2/1988 | Curtis |
| 4,741,116 | A | 5/1988 | Engle et al. |
| 4,779,363 | A | 10/1988 | Boutrais et al. |
| 4,962,599 | A | 10/1990 | Harris |
| 4,962,600 | A | 10/1990 | Zellaha et al. |
| 4,976,053 | A | 12/1990 | Caley |
| 5,027,536 | A | 7/1991 | Farrell |
| 5,092,409 | A | 3/1992 | Defrancq |
| 5,111,603 | A | 5/1992 | Knowlton et al. |
| 5,148,617 | A | 9/1992 | Feller et al. |
| 5,195,261 | A | 3/1993 | Vachon |
| 5,285,588 | A | 2/1994 | Niemela et al. |

(Continued)

*Primary Examiner* — Robert E Pezzuto
(74) *Attorney, Agent, or Firm* — Reinhart Boerner Van Deuren s.c.

(57) ABSTRACT

A snow plow rebounding system is provided. A cushion block and shock-absorbing springs serve to cushion a snow plow rotating about a horizontal axis.

30 Claims, 24 Drawing Sheets

U.S. PATENT DOCUMENTS 5,353,530 A 10/1994 Pieper
5,568,694 A 10/1996 Capra et al.
5,638,618 A 6/1997 Niemela et al.
5,647,153 A 7/1997 Gervais
5,655,318 A 8/1997 Daniels
5,758,728 A 6/1998 Ragule
5,819,444 A 10/1998 Desmarais
5,848,654 A 12/1998 Belcher, Jr.
5,860,230 A 1/1999 Daniels
5,894,688 A 4/1999 Struck et al.
5,894,689 A 4/1999 Turk
5,899,007 A 5/1999 Niemela et al.
5,924,223 A 7/1999 Hone, Jr.
6,012,240 A 1/2000 Klug et al.
6,044,579 A 4/2000 Hadler et al.
6,145,222 A 11/2000 Curtis
6,151,808 A 11/2000 Curtis
6,170,178 B1 1/2001 Christy
6,209,231 B1 4/2001 Curtis
6,240,659 B1 6/2001 Curtis et al.
6,314,666 B1 11/2001 Klemenhagen et al.
6,354,024 B1 3/2002 Kost et al.
6,363,629 B1 4/2002 Curtis
6,381,880 B1 5/2002 Curtis
6,408,546 B2 6/2002 Curtis
6,408,549 B1 6/2002 Quenzi et al.
6,412,199 B1 7/2002 Quenzi et al.
6,425,196 B1 7/2002 Weagley et al.
6,442,877 B1 9/2002 Quenzi et al.
6,526,677 B1 3/2003 Bloxdorf et al.
6,557,275 B2 5/2003 Curtis
6,594,923 B1 7/2003 Kost et al.
6,594,924 B2 7/2003 Curtis
6,615,513 B2 9/2003 Quenzi et al.
6,618,964 B2 9/2003 Kost et al.
6,691,435 B1 2/2004 Schultz et al.
6,711,837 B2 3/2004 Bloxdorf et al.
6,775,933 B2 8/2004 Koch et al.
6,860,040 B2 3/2005 Schultz et al.
6,883,436 B2 4/2005 Fuerst
6,928,757 B2 8/2005 Bloxdorf et al.
6,941,685 B2 9/2005 Goy et al.
6,944,978 B2 9/2005 LeBlond et al.
6,964,121 B2 11/2005 Harris
7,017,288 B1 3/2006 Megli
7,103,995 B2 9/2006 Curtis
7,114,270 B2 10/2006 Potak
7,117,617 B2 10/2006 Kost et al.
7,134,227 B2 11/2006 Quenzi et al.
7,146,754 B2 12/2006 Schultz et al.
7,228,650 B2 6/2007 Curtis
7,290,359 B2 11/2007 Potak
7,334,357 B1 2/2008 Altheide
7,353,628 B2 4/2008 Potak
7,360,327 B2 4/2008 Osgood et al.
7,437,839 B2 10/2008 Christy et al.
7,481,011 B2 1/2009 Nesseth
7,513,069 B1 4/2009 Gamble, II et al.
7,526,883 B2 5/2009 Musso, Jr. et al.
7,654,016 B2 2/2010 Stephan
2004/0079002 A1 4/2004 Goy et al.
2004/0088892 A1 5/2004 Kost et al.
2004/0172858 A1 9/2004 Bloxdorf et al.
2005/0076543 A1 4/2005 Curtis
2005/0120595 A1 6/2005 Bloxdorf et al.
2005/0144814 A1 7/2005 Potak
2005/0206126 A1 9/2005 Harris
2006/0005435 A1 1/2006 Gamble, II et al.
2006/0010722 A1 1/2006 LeBlond et al.
2006/0055150 A1 3/2006 Curtis
2006/0059727 A1 3/2006 Yoder
2007/0068049 A1 3/2007 Quenzi et al.
2007/0089325 A1 4/2007 Watson
2007/0089327 A1 4/2007 Watson
2008/0073090 A1 3/2008 Harris
2008/0115392 A1 5/2008 Musso et al.
2008/0263907 A1 10/2008 Winter
2009/0307938 A1 12/2009 Koch et al.
2009/0307940 A1 12/2009 Maas et al.
2009/0307941 A1 12/2009 Gamble, II

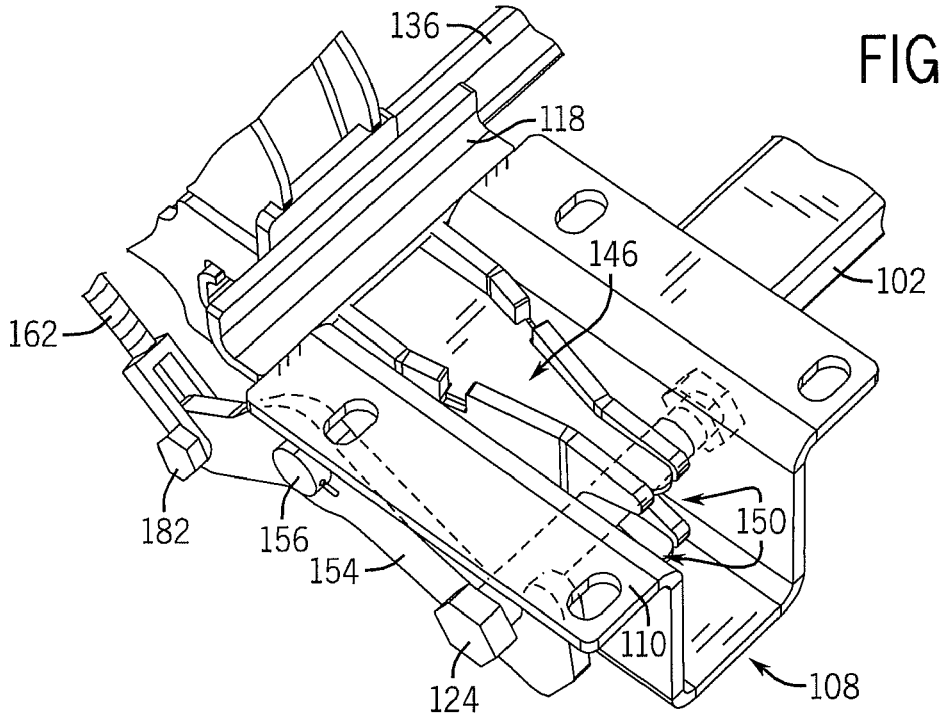
FIG. 10
FIG. 11
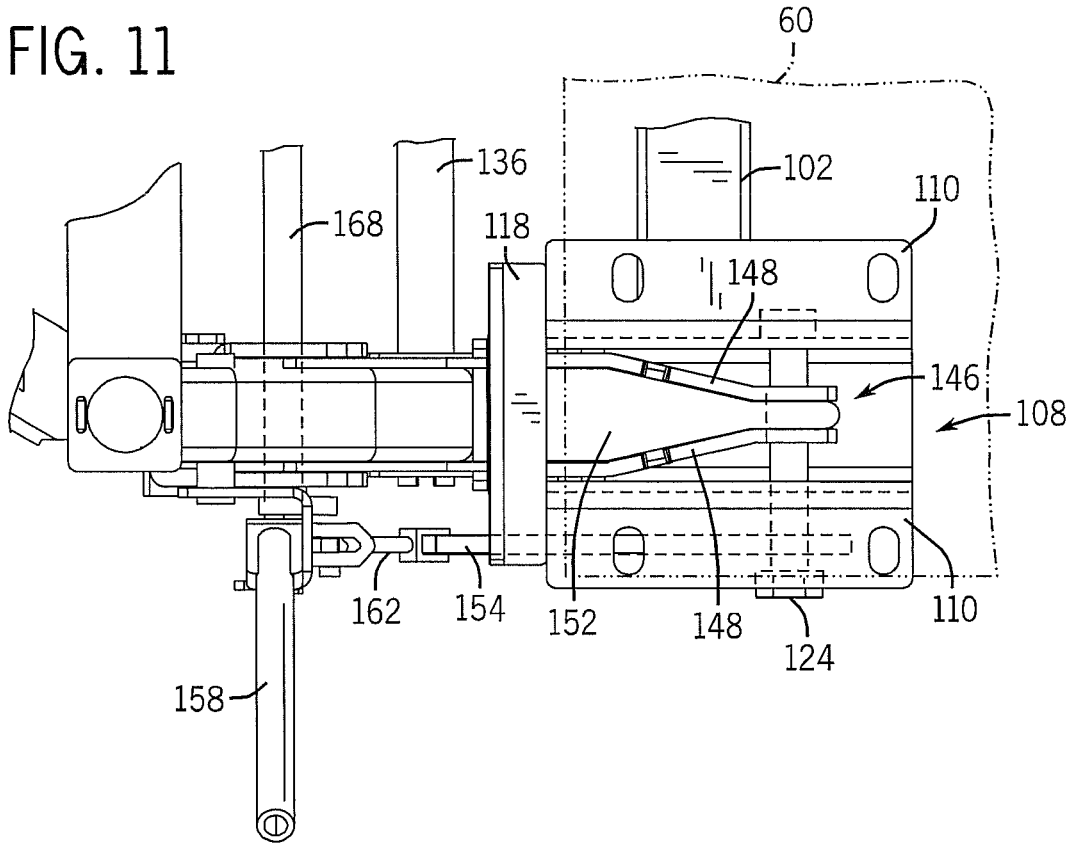

SNOW PLOW REBOUND APPARATUS

CROSS-REFERENCE TO RELATED APPLICATIONS

This application claims the benefit of U.S. Provisional Application No. 61/073,252, filed Jun. 17, 2008. This application is related to U.S. patent application Ser. No. 12/140,509; U.S. Provisional Application No. 61/073,227; U.S. Provisional Application No. 61/073,231; U.S. Provisional Application No. 61/073,241; U.S. Provisional Application No. 61/073,248; U.S. patent application Ser. Nos. 12/140,903; 12/140,881; 12/140,466; 12/140,893; 12/140,886; 12/140,732; 12/140,635; and 12/140,671. Each of these Patent Applications was filed Jun. 17, 2008. The entirety of these applications are hereby incorporated herein by reference.

BACKGROUND OF THE INVENTION

Field Of The Invention

The present invention relates generally to material handling equipment, and more particularly to a plow with a hitch mechanism configured to be easily and quickly coupled to a vehicle and a plow blade rebound apparatus configured to cushion blade impact with a plow frame.

It is known that plows, for example snow plows, are bolted to supports which are typically welded to the chassis of a vehicle, for example a truck. It is also known that a plow support can be bolted to the chassis of a vehicle. Since plows typically weigh hundreds of pounds, positioning the plow for attachment to the vehicle can be difficult. It is particularly difficult to maneuver a snow plow in the cold and snow of winter.

It is also known to provide a plow with wings. Typically, the wings move in a horizontal direction to extend the width of the plow working width. It is also known to provide a plow wings that move in response to a pivoting movement of the central plow. In some cases the movement of the wing is facilitated by linkage such as cables, coupled to the wing and central plow such that that the wing moves in response to the central plow movement.

Accordingly, it is desirable to provide a plow hitch mounting mechanism which is easy to maintain and that the process of connecting and disconnecting the plow to or from the vehicle is simple and easy to use by one person without assistance. It is also desirable to provide a plow including wings that move independently of the main or central plow.

The apparatus of the present disclosure must also be of construction which is both durable and long lasting, and it should also require little or no maintenance to be provided by the user throughout its operating lifetime. In order to enhance the market appeal of the apparatus of the present disclosure, it should also be of inexpensive construction to thereby afford it the broadest possible market. Finally, all of the aforesaid advantages should be achieved without incurring any substantial relative disadvantage.

It is known that snow plows generally can at times strike objects such as rocks, curbs or other obstructions. In the case of snow plows that are known generally, contact with such obstructions can cause damage to the snow plows and to the appartus connecting the plows to the vehicles controlling the snow plows.

Therefore, it is desirable to have a mechanism that would allow a snow plow to contact an object without damaging the snow plow or the connection appartus connecting the snow plow to the vehicle controlling the snow plow. It would also be desirable that this mechanism could be maintenanced without disconnecting the snow plow from the vehicle.

SUMMARY OF THE INVENTION

The disadvantages and limitations of the background art discussed above are overcome by the present invention.

There is provided a snow plow rebound apparatus for a snow plow. The snow plow includes a snow plow blade, capable of partially rotating about a horizontal axis, with a plowing side and non-plowing side, coupled to a snow plow frame, which is in turn coupled to a snow plow mounting apparatus. The snow plow blade, snow plow frame and mounting apparatus are protected from damage due to rotation of the snow plow blade about the horizontal axis by the snow plow rebound apparatus. The snow plow rebound apparatus has front trip spring mounts coupled to the non-plowing side of the snow plow blade. Coupled to these front spring mounts are a first end of a plurality of springs. A plurality of trip spring brackets are composed of rear trip spring mounts and cushion trip plates. These trip spring brackets are coupled to the snow plow frame. The second ends of the springs are coupled to the rear trip spring mounts. A plurality of cushion mounts are coupled to the non-plowing side of the snow plow blade, and a plurality of cushion blocks are coupled to the cushion mounts. The cushion blocks are positioned to contact the cushion trip plates of the trip spring brackets when the top of the snow plow blade rotates toward the snow plow frame about the horizontal axis.

In another embodiment the cushion blocks are rectangular in shape and are composed of a high density, resilient material. In yet another embodiment, the high density resilient material is polyurethane. In another embodiment, the cushion blocks are configured to be removed and replaced while the snow plow blade is coupled to the snow plow frame, and the snow plow frame is coupled to the snow plow mounting apparatus.

There is also provided a method of cushioning a snow plow. The snow plow includes a snow plow blade, configured to partially rotate about a horizontal axis from a first, vertical configuration to a second, non-vertical configuration, and having a plowing side and a non-plowing side, coupled to a snow plow frame, which in turn is coupled to an apparatus for connecting the snow plow to a vehicle. The method includes coupling a first end of a plurality of springs to the non-plowing side of the snow plow blade. The method also includes coupling the second of the springs to the snow plow frame. The springs are configured in such a way as to bias the snow plow blade against rotating about the horizontal axis. The method also includes coupling a cushion block to the non-plowing side of the snow plow blade, and positioning the block between the snow plow blade and the snow plow frame. When the snow plow blade rotates from a first, vertical configuration to a second, non-vertical configuration, the springs tend to resist this rotation. The cushion block is configured to absorb the impact between the snow plow blade the snow plow frame when the springs return the snow plow blade from the second, non-vertical configuration to the first, vertical configuration.

In another embodiment the cushion blocks are rectangular in shape and are composed of a high density, resilient material. In yet another embodiment, the high density resilient material is polyurethane. In another embodiment, the cushion blocks are configured to be removed and replaced while the snow plow blade is coupled to the snow plow frame, and the snow plow frame is coupled to the snow plow mounting apparatus.

There is also provided a snow plow which includes a snow plow blade, having a non-plowing side and a plowing side and configured to partially rotate about a horizontal axis, and the snow plow blade is coupled to a snow plow frame. The snow plow includes a plurality of front trip spring mounts that are coupled to the non-plowing side of the snow plow blade. The snow plow also includes a plurality of springs with first and second ends, with the first ends coupled to the front trip spring mounts. The snow plow also includes a plurality of trip spring brackets, including a plurality of rear trip spring mounts and a plurality of cushion trip plates, with the trip spring brackets coupled to the snow plow frame, and the second ends of the springs coupled to the rear trip spring mounts. The snow plow also includes a plurality of cushion mounts coupled to the non-plowing side of the snow plow blade, and includees a plurality of cushion blocks coupled to the cushion mounts, positioned such that the cushion blocks contact the cushion trip plates to halt the rotation about the horizontal axis of the portion of the snow plow blade above the horizontal axis of rotation toward the snow plow frame.

In another embodiment the cushion blocks are rectangular in shape and formed from a high density, resilient material. In yet another embodiment, the high density, resilient material is polyurethane. In another embodiment, the cushion blocks are configured to be removed and replaced while the snow plow blade is coupled to the snow plow frame.

There is also provided a method of installing a cushion block in a snow plow apparatus. The snow plow appartus includes a swing frame and a plow blade. The swing frame includes a cushion trip plate. The cushion trip plate defines at least one cushion bolt aperture. The plow blade includes a cushion mount. The method includes rotating the plow blade in a first direction about a horizontal axis, placing the cushion block between the cushion trip plate and the cushion mount, rotating the plow blade in a second direction, the second direction being the opposite of the first direction, about the horizontal axis until the cushion trip plate and cushion mount both engage the cushion block, and inserting at least one fastener through the cushion bolt aperture to couple the cushion block to the cushion mount. The cushion block is installed without removing the plow blade from the swing frame.

DESCRIPTION OF THE DRAWINGS

These and other advantages of the present invention are best understood with reference to the drawings, in which:

FIG. 10 is a detail perspective view of a chassis coupler engaged with a notched member of the hitch frame mechanism illustrated in FIG. 3.

FIG. 11 is a top view of the chassis coupler illustrated in FIG. 10.

DETAILED DESCRIPTION OF THE EXEMPLARY EMBODIMENTS

There is disclosed a snow plow 50 for mounting on a vehicle 60 with a quick connection/disconnect hitch 70 (more fully described below). The quick connect/disconnect hitch 70 facilitates the easy connection, i.e., without tools and disconnection of the snow plow 50 from the vehicle 60.

Figures 1, 2:
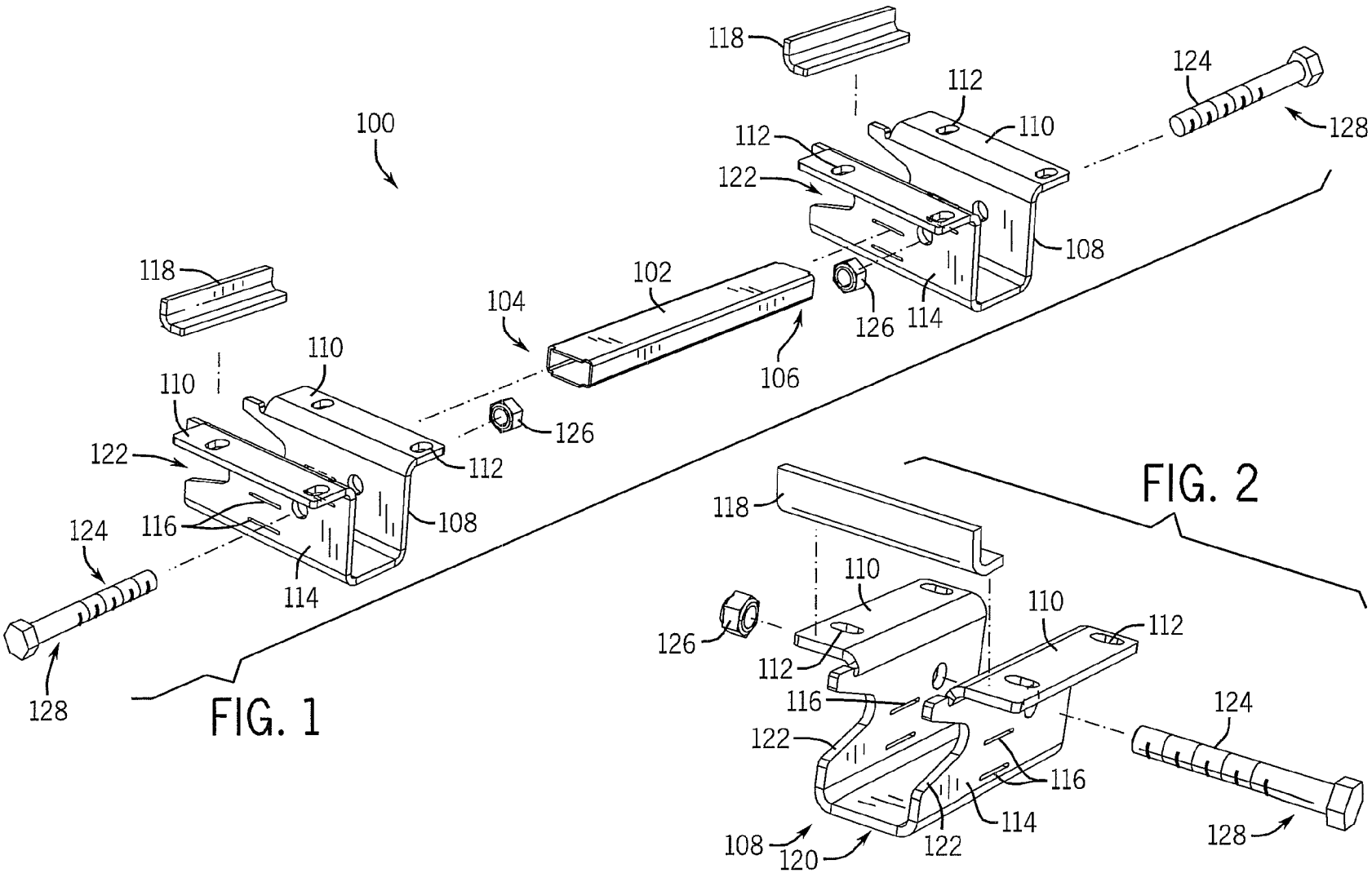
FIG. 1 is an exploded, isometric view of an exemplary embodiment of a hitch frame nose assembly.
FIG. 2 is a detail view of an exemplary embodiment of a chassis coupler of the hitch frame nose assembly illustrated in FIG. 1.

Referring to FIGS. 1 and 2, a hitch frame nose assembly 100 includes a hitch frame tube having a first end 104 and a second end 106. Coupled to each end of the hitch nose tube 102 is a chassis coupler 108. Each chassis coupler 108 mounts to the vehicle chassis 60. In a typical set up, each of the chassis couplers 108 will be secured to a frame member of the vehicle chassis 70 (not shown) by bolting the chassis coupler 108 to the vehicle chassis 60. It is also contemplated that the chassis coupler 108 can be welded to the vehicle chassis 60 as determined by the user of the quick connect/disconnect hitch 70.

Each chassis coupler 108 is a formed U-shaped channel with outward extending flanges. The flanges 110 are configured to provide a mounting surface for the chassis coupler 108 to facilitate coupling of the chassis coupler 108 to the vehicle chassis 60. Each flange 110 defines a plurality of apertures 112 to facilitate bolting of the chassis coupler 108 to the vehicle chassis 60. The apertures 112 may be configured as circles or slots. Each side 114 of each chassis coupler 108 further defines a pair of slots 116 extending longitudinally along and through each side 114 of the chassis coupler 108. The slots 116 facilitate the coupling of the hitch frame tube 102 to each of the chassis couplers 108 comprising the hitch frame nose assembly 100. Each chassis coupler 108 may be provided with slots 116 on each side 114 of the chassis coupler 108 to facilitate manufacturing and assembly by providing commonality of parts. Each chassis coupler 108 is also provided with an end-stop coupled to each of the flanges 110 proximate the front end 120 of the chassis coupler 108. The end-stop 118 assists in positioning the chassis coupler 108 on the vehicle chassis 60. Each chassis coupler 108 also defines a substantially V-shaped notch 122 to accommodate a lock hook pivot more fully described below. Each chassis coupler 108 also includes a traverse pin 124 which extends through both sides 114 of the chassis coupler 108. Traverse pin 124 is secured to the chassis coupler 108 by a nut threadingly fastened to the traverse pin 104. The nut may further be welded to the chassis coupler 108 to further secure the traverse pin 124. A portion 128 of the traverse pin extends beyond the side 114 of the chassis coupler 108 and is configured to engage a locking hook more fully described below.

Figure 3A:
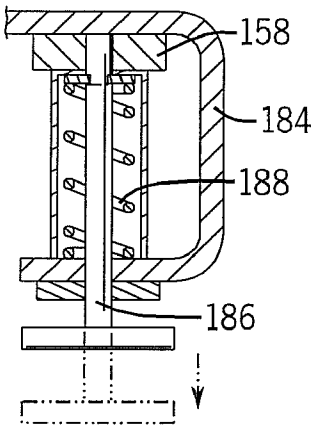
FIG. 3A is a cross-sectional view of an exemplary embodiment of a spring biased retaining pin along the line 3A-3A of FIG. 3.
Figure 3:
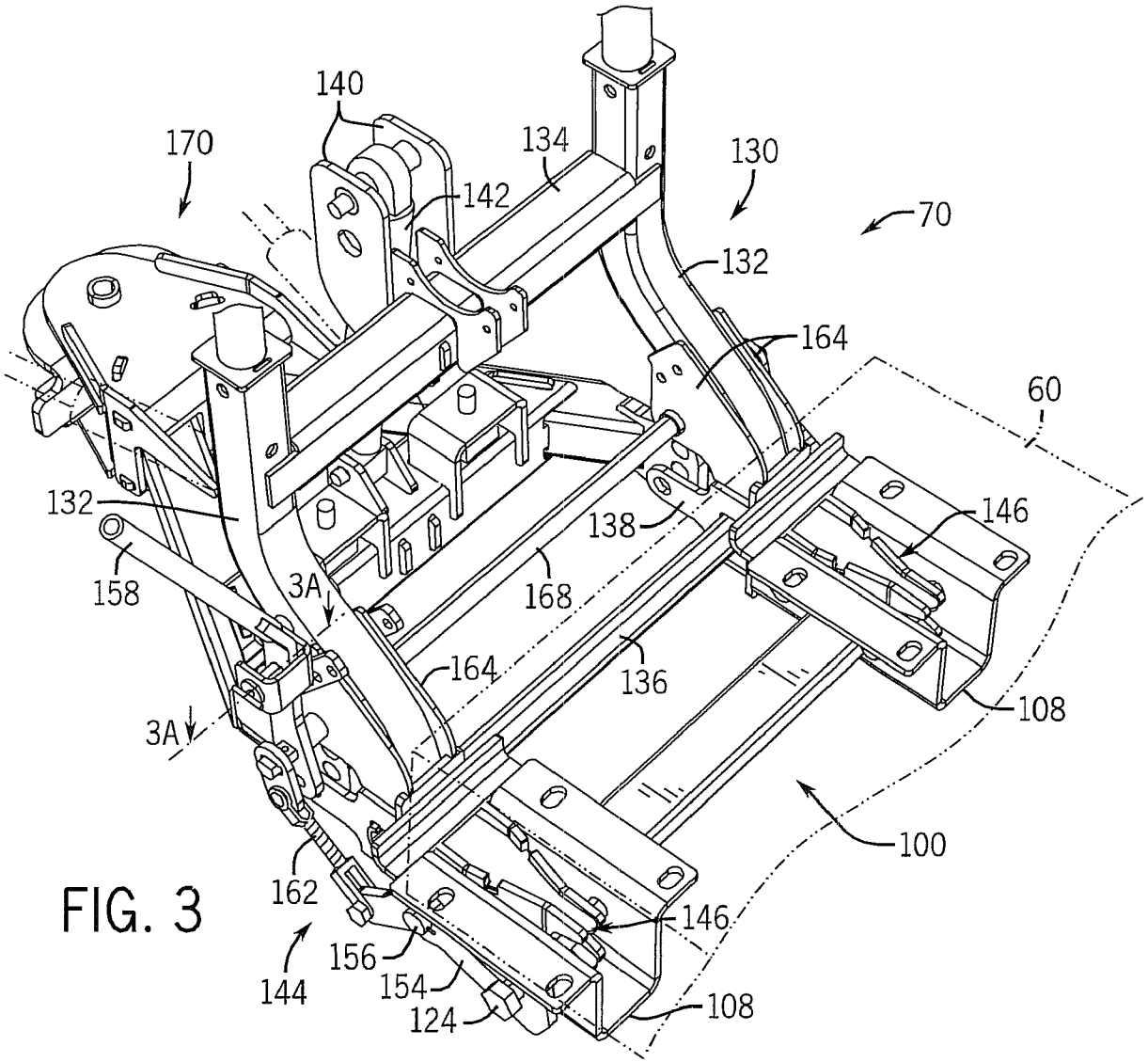
FIG. 3 is an isometric rear view of an exemplary embodiment of a hitch mechanism coupled to a vehicle.

FIG. 3 illustrates an exemplary embodiment of a quick connect/disconnect hitch 70 assembly. The hitch frame nose assembly 100 is coupled to a vehicle chassis 60. Coupled to the hitch frame nose assembly 100 is the lift bar assembly 130 which in turn is coupled to a plow frame 170.

Figure 12:
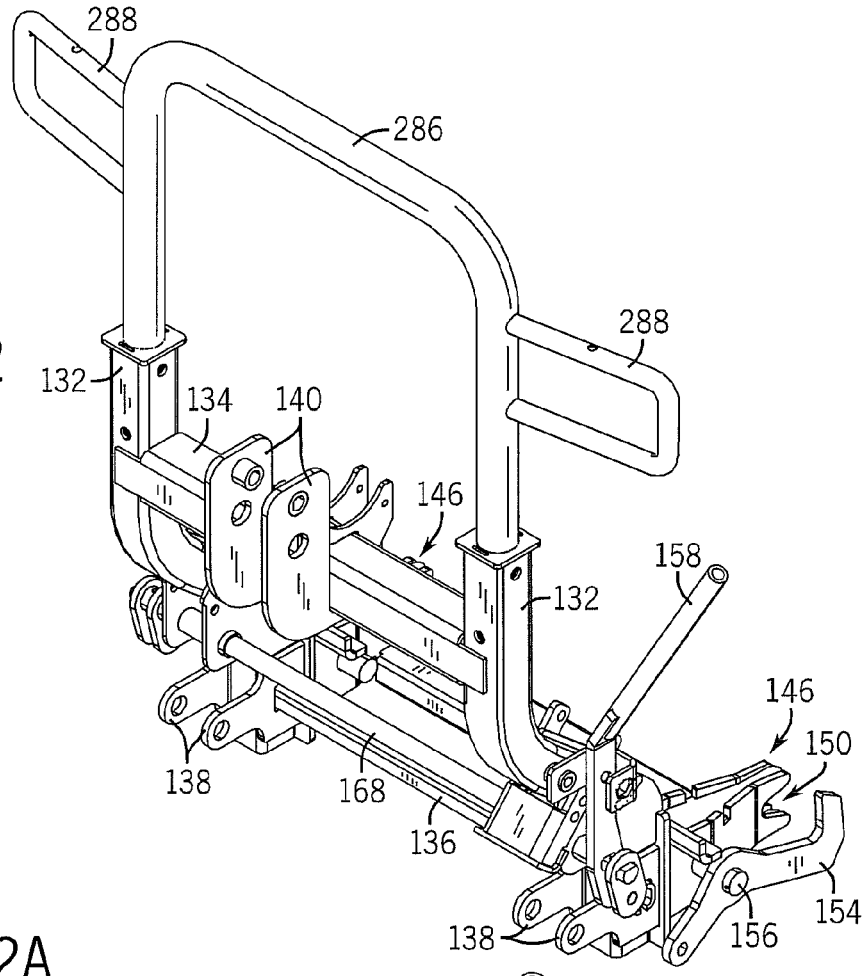
FIG. 12 is an isometric rear view of an exemplary embodiment of a lift bar assembly of the hitch mechanism illustrated in FIG. 3.
Figure 12A:
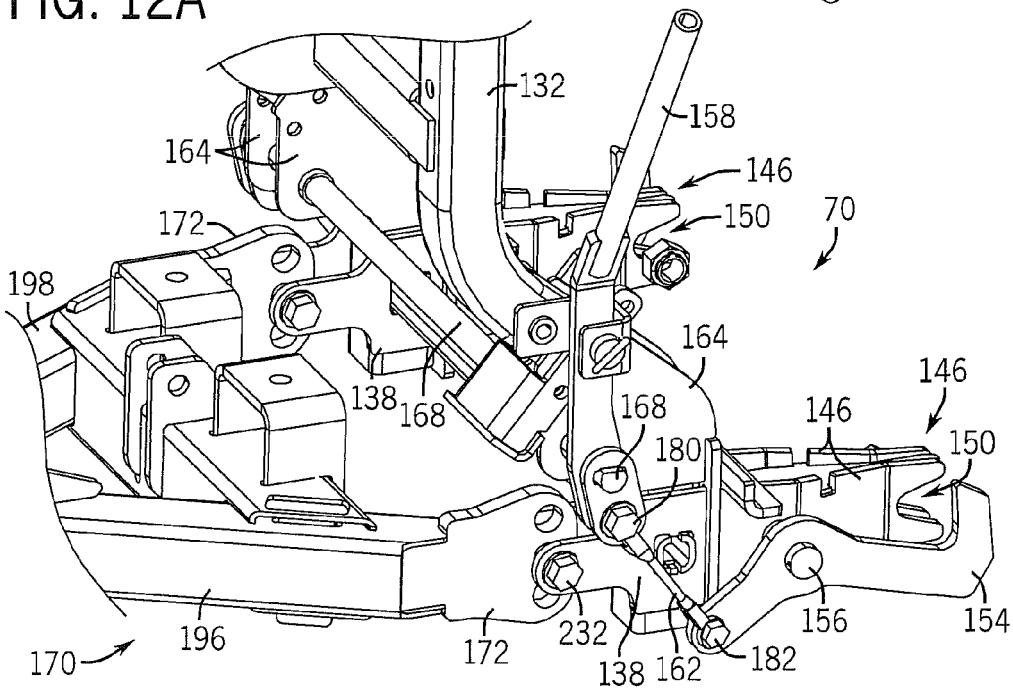
FIG. 12A is a partial view of the lift bar assembly illustrated in FIG. 12, illustrating the lift bar assembly coupled to the rear portion of a plow frame in one of a plurality height adjustment orifices.
Figure 12B:
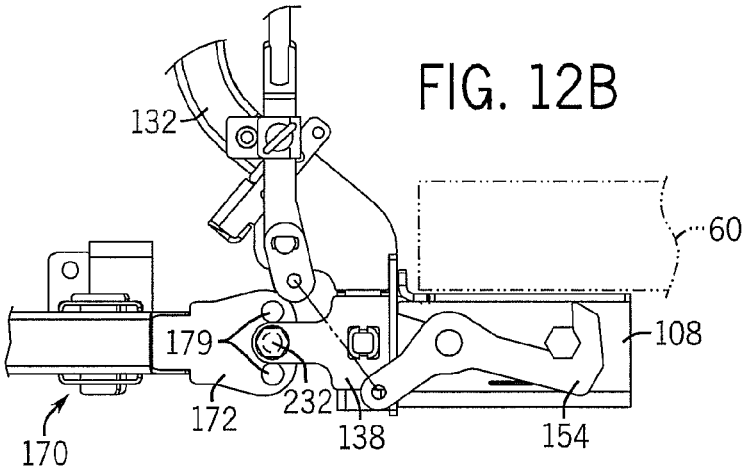
FIG. 12B is a partial side elevation of the hitch mechanism illustrated in FIG. 3.
Figure 12C:
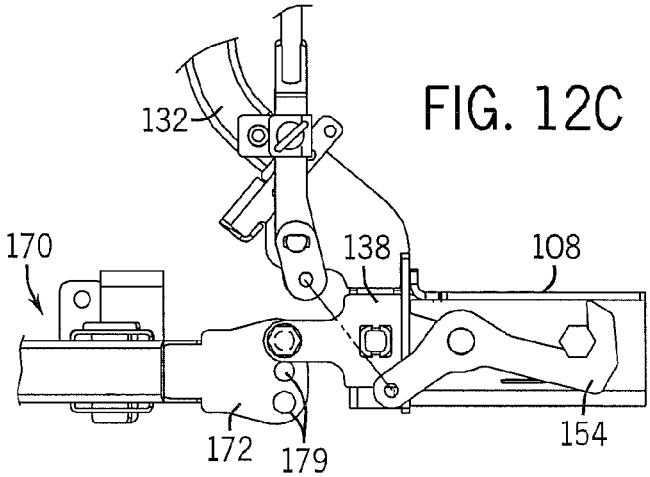
FIG. 12C is a partial side elevation of the hitch mechanism illustrated in FIG. 3 with the lift bar assembly coupled to the plow frame in an alternative height adjustment orifice.

The lift bar assembly 130 includes a pair of lift bar support members 132 maintained in a spaced apart relationship and coupled to a lift bar approximate the top of each lift bar support member 132. A light bar brace 136 approximate the lower end of each lift bar support member 132 facilitates maintenance of the spaced apart relationship of the lift bar support member 132. A pair of lift bar lugs 138 are coupled to each lift bar support member 132 approximate the light bar brace 136. (Also see FIGS. 12 and 12*a*). Coupled to the lift bar 134 are a pair of upper lift cylinder mounts 140 configured to operably secure a power mechanism, for example a lift cylinder 142. Also coupled to the lift bar assembly 130 is a locking mechanism 144.

Figure 4:
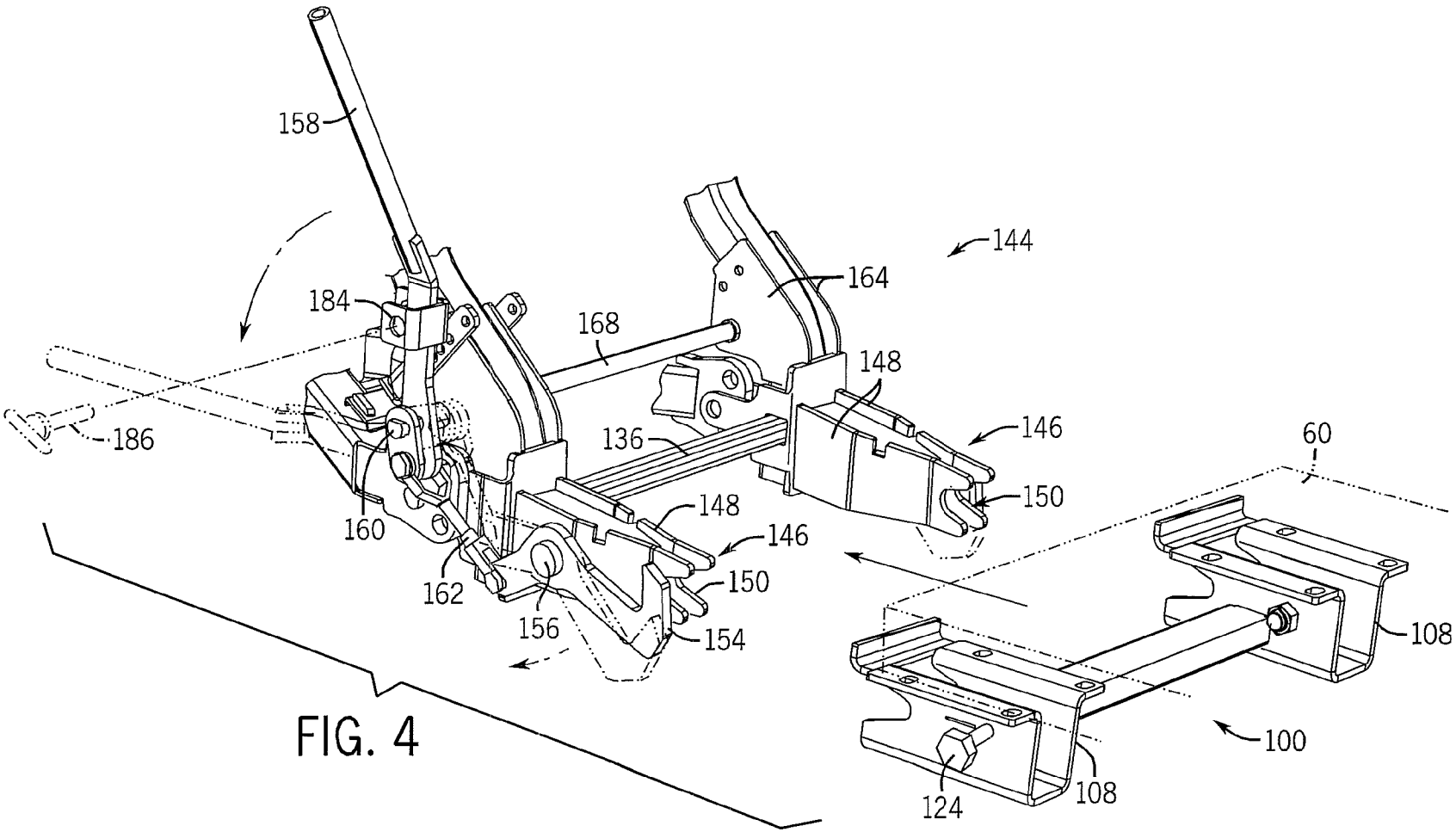
FIG. 4 is an isometric view of the hitch mechanism illustrated in FIG. 3 uncoupled from the hitch frame nose assembly.

Referring to FIG. 4, there is illustrated a hitch frame nose assembly 100 coupled to a vehicle chassis 60 and positioned to receive a locking mechanism 144 of a quick connect/disconnect hitch 70. The locking mechanism 144 includes a pair of notched members 146 coupled to the lift bar assembly 130 and positioned to correspond for engagement with each of the chassis couplers 108 of the hitch frame nose assembly 100.

Each notch member 146 includes a pair of tapered side members 148 with each tapered side member 148 defining a notch 150. Each notch 150 is configured to engage the traverse pin 124 positioned between the two sides 114 of each chassis coupler 108. Each notch member 146 also includes a plate member 152 fastened to the top portion of each of the tapered side members 148, typically by welding a plate member 150 to each tapered side member 148. The plate member provides additional reinforcement for the notch member 146 and defines with the two tapered side members 148 an inverted U-shape assembly. With the notch member 146 engaged with the chassis coupler 108 the pivot for the quick connect/disconnect hitch 70 formed by the engagement of the notch 150 with the traverse pin 124 is enclosed within the two facing u-shaped assemblies.

Each notched member 146 further includes a locking hook 154 pivotally coupled to a hook pivot 156. The hook pivot 156 extends through each of the tapered side members 148 of each notch member 146. The locking hook 154 moves about the hook pivot 156 in response to movement of the hitch locking lever 158 as the hitch locking lever 158 moves about a lever pivot 160. The hitch locking lever 158 is coupled to the locking hook 154 by a lock linkage 162. The operation of the locking mechanism 144 will be explained below.

The orientation of the locking hook 154 and the notch member 146 is such that when the notch member 146 is inserted into the chassis coupler 108 the locking hook is positioned outside of the unshaped chassis coupler 108 and positioned to selectively engage the portion 128 of the traverse pin 124 that extends beyond the side 114 of the chassis coupler 108. It should be understood that there is a locking hook 154 on each of the notch members 146 which engages the traverse pin 124 extending beyond the side 114 of each of the chassis couplers 108 that are part of the hitch frame nose assembly 100. The locking hook 154 locks the lift bar assembly 130 to the hitch frame nose assembly 100.

Locking mechanism 144 also includes a lock support bracket 164 which is coupled to each of the lift bar support members 132. A preferred embodiment provides that a pair of lock support brackets 164 are coupled to each side of the corresponding lift bar support member 132. (FIGS. 3 and 4) It should be understood that the locking mechanism 144 includes a locking hook 154, hook pivot 156, lock linkage 162 on each outward side of the lift bar assembly 130. On one side of the lift bar assembly 130, the hitch locking lever 158 is coupled to the linkage, and on the other side of the lift bar assembly 130 the lock linkage 162 is coupled to a lock linkage bracket 166. (See FIG. 9). The lock linkage bracket 166 and the hitch locking lever 158 are coupled together by a hitch lock extension rod 168 extending through each of the lock support brackets 164 and each of the lift bar support members 132. The hitch lock lever 158 and the lock linkage bracket 166 are journaled to the hitch lock extension rod 168 by a flat face defined on each end of the hitch lock extension rod 168. (See FIGS. 8 and 9).

Figure 5:
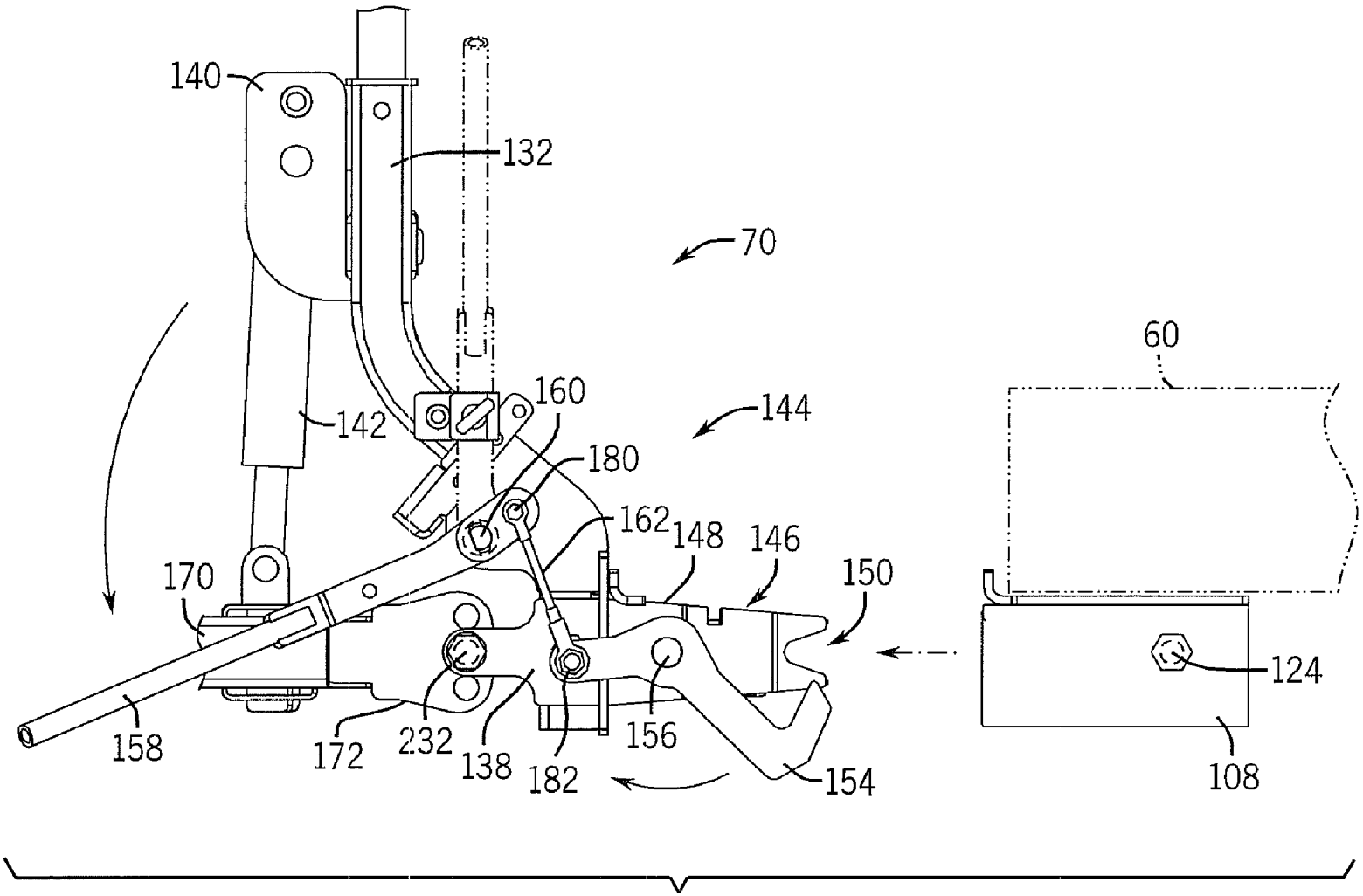
FIG. 5. is a side elevation of the hitch mechanism illustrated on FIG. 4.

The operation of coupling the quick connect/disconnect hitch 70 to the vehicle chassis 60 will now be described with reference to FIGS. 5 through 9. FIG. 5 illustrates an exemplary embodiment of a quick connect/disconnect hitch 70 positioned to engage the hitch frame nose assembly 100 coupled to a vehicle chassis 60. The hitch locking lever 158 is in an unlocked position 174. The movement of the hitch lock lever 158 to the unlocked position 174 rotated the locking hook as illustrated in FIG. 5. The vehicle having a hitch frame nose assembly 100 coupled to the vehicle chassis 60 is moved towards the quick connect/disconnect hitch 70 as indicated by the arrow in FIG. 5.

Figure 6:
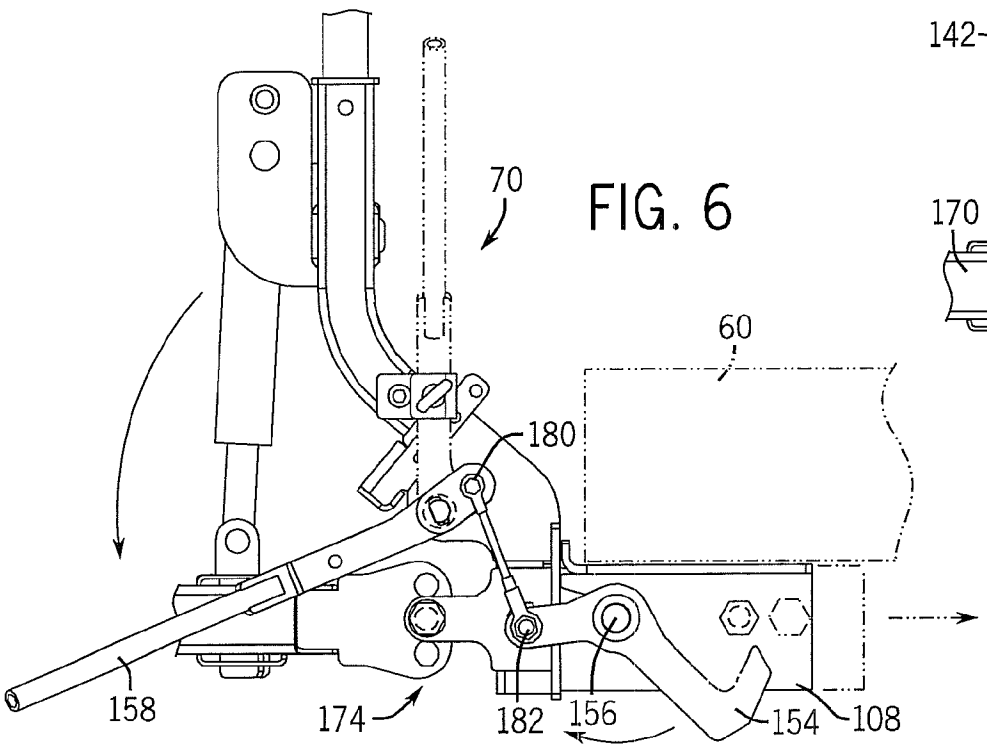
FIG. 6 is a side elevation of the hitch mechanism illustrated in FIG. 3 with the hitch mechanism configured to uncouple from the hitch frame nose assembly.

FIG. 6 illustrates the quick connect/disconnect hitch 70 engaged with the hitch frame nose assembly 100 with each notched member 146 of the lift bar assembly 130 coupled to the traverse pin 124 in each of the chassis couplers 108. Such engagement is illustrated at least in FIGS. 10 and 11. In this position, with the hitch locking lever 158 still in the unlocked position 174 the vehicle can be moved away from the hitch 70 if additional adjustment maneuvers are necessary.

Figure 7:
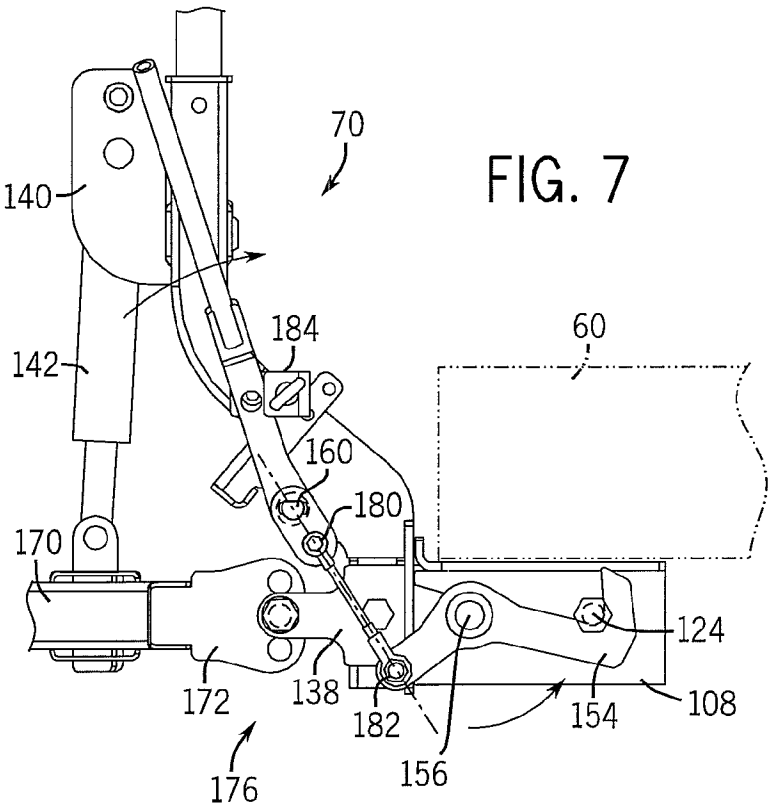
FIG. 7 is side elevation of the hitch mechanism illustrated in FIG. 3 with the hitch mechanism coupled to a chassis coupler of the hitch frame nose assembly and illustrating the hitch locking lever in a first lock position.

FIG. 7 illustrates the locking mechanism 144 in a first locked position 176. In the first locked position 176, the locking hook has moved to engage the traverse pin 124 in each of the chassis couplers 108. In this configuration, the lever pivot 160, the hitch locking lever linkage attachment 180 and the hook linkage attachment 182 are substantially in a straight line as illustrated in FIG. 7.

Figure 8:
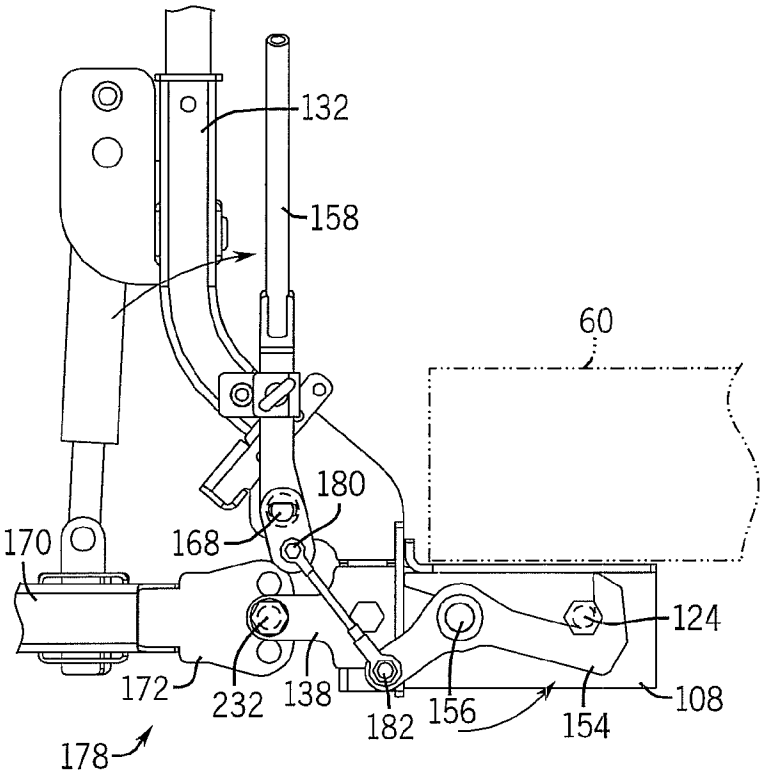
FIG. 8 is a side elevation of the hitch mechanism illustrated in FIG. 7 and illustrating the hitch locking lever in a second lock position.

To complete the locking maneuver of the locking mechanism 144, the hitch locking lever 158 is moved to a second locked position 178 which forces the hitch locking lever 158 to move over center of the lever pivot 160 as illustrated in FIG. 8. The hitch locking lever 158 also is secured in a retaining bracket 184 coupled to a locked support bracket 164. The retaining bracket 184 includes a retaining pin 186 which is biased by a spring 188. The retaining pin 186 engages an orifice defined in the hitch lever locking lever 158 as illustrated in FIG. 3A. It should be understood that other ways of securing the locking lever 158 can be used to prevent the locking lever 158 from inadvertently unlocking the hitch 70.

Figure 9:
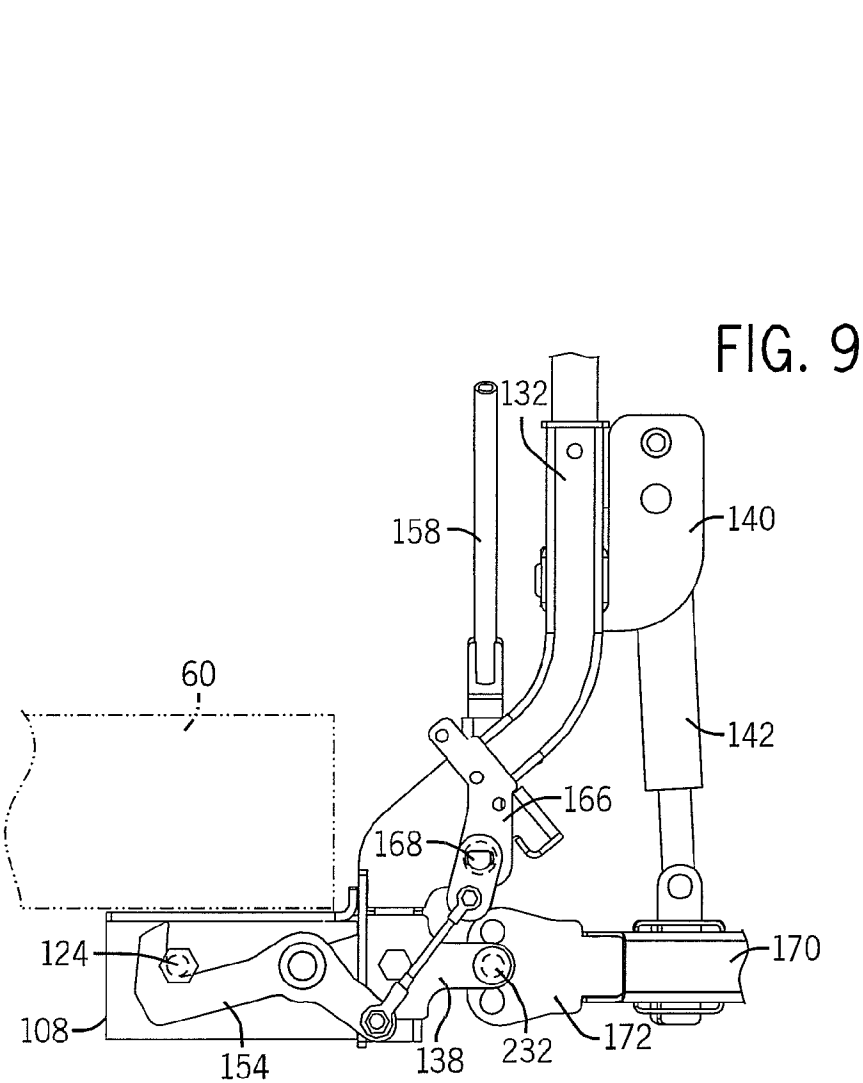
FIG. 9 is a side elevation of another side of the hitch mechanism illustrated in FIG. 8.

As described above, the locking mechanism 144 includes a lock hook 154 on each side of the lift bar assembly 130 and are coupled together to simultaneously operate with movement of the hitch locking lever 158. FIG. 9 illustrates the other side of the locking mechanism 144 illustrated in FIG. 8.

The lift bar assembly 130 is coupled to a plow frame 170. The lift bar assembly 130 is provided with a pair of lift bar lugs 138 coupled to the lift bar brace 136 and to each of the lock support brackets 164 on both sides of the lift bar assembly 130 (see FIG. 12).

A plow frame 170 is configured substantially in the form of a letter A with the plow frame 170 including a front portion 175 and a rear portion 177. The plow frame 170 includes two side member 196, 198 which form the sides of the A-shape with a traverse brace tube 200 coupled to each of the side members 196, 198. The side members 196, 198 and the traverse brace tube 200 are conventional steel square tubing, however, it is contemplated that other cross-section configured tubes, for example circular or triangular, can be used. Coupled to the front portion 175 of the plow frame 170 is a swing frame pivot assembly 185. The swing frame pivot assembly includes a top plate 187 and a bottom plate 189. Each of the plates 187, 189 defines an orifice configured to receive a swing frame pivot pin 190. The swing frame pivot assembly 185 is further coupled to each of the side members 196, 198 of the plow frame 170 by a pair of side support brackets 192, 194 which are configured to couple to each of the top plate 187, the bottom plate 189 and one of the side members of the plow frame 170.

Figure 13:
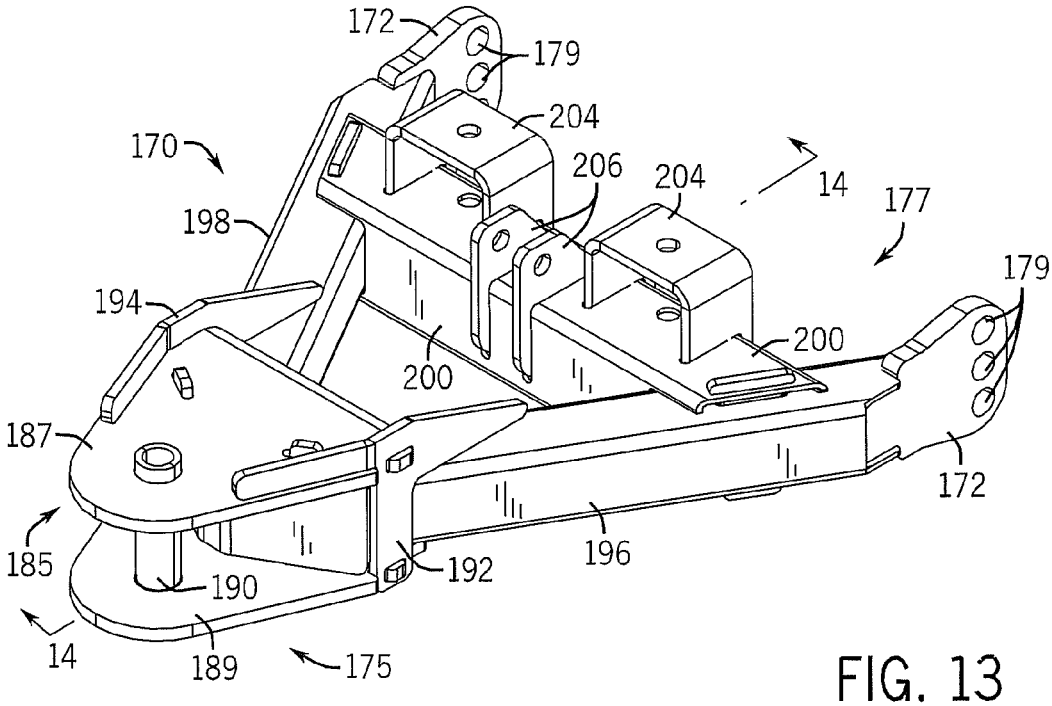
FIG. 13 is an isometric, top, front view of an exemplary embodiment of an A-frame plow frame assembly of the hitch mechanism illustrated in FIG. 3.
Figure 14:
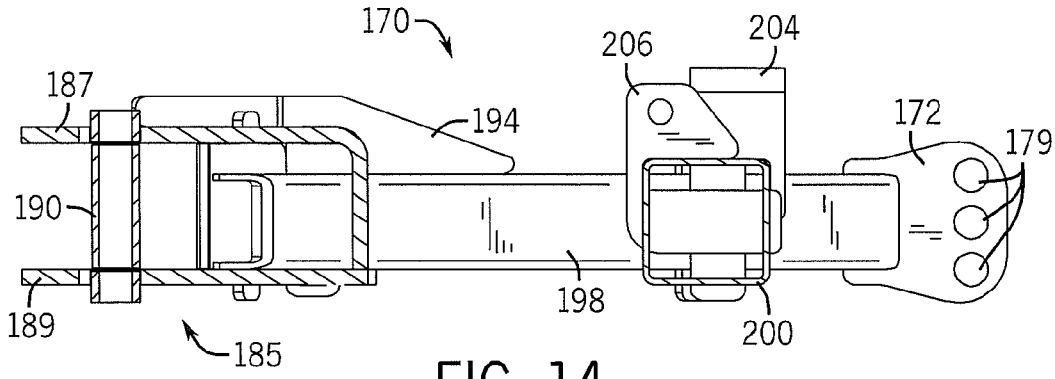
FIG. 14 is a cross sectional view of the plow frame illustrated in FIG. 13 along the line 14-14.

In one embodiment, a portion of the top plate 187 is bent downwardly at a 90 degree angle to extend the top plate 187 to the bottom plate 189 with that portion of the top plate configured to define an angled pocket to receive each of the side members 196, 198 of the plow frame 170. See FIGS. 13 and 14.

Coupled to the traverse brace tube 200 are lift cylinder mounts 206 and a pair of swing cylinder mounts 202 and 204. Lift cylinder mounts 206 are aligned to couple the lower end of the lift cylinder 142 which is coupled to the upper lift cylinder mount 140 on the lift bar 134.

Each of the side members 196, 198 of the plow frame 170 include an adjustment lug 172 at the rear portion 177 of the plow frame 170. Each adjustment lug 172 includes a plurality of orifices 179 aligned vertically and configured to receive a bolt 232 which will couple the plow frame 170 to the lift bar lugs 138 on the lift bar assembly 130. As best seen in FIGS. 12, 12A, 12B, and 12C, the adjustment lug 172 is received between each of the lift bar lugs 138 of the lift bar assembly 130 and secured with a bolt 232. In order to adjust the plow frame height relative to the vehicle, an operator will select one of the vertical adjustment orifices 179 to properly align the plow frame 170 with the lift bar assembly 130 which is in turn coupled with the chassis couplers 108 of the hitch frame nose assembly 100.

Figure 15:
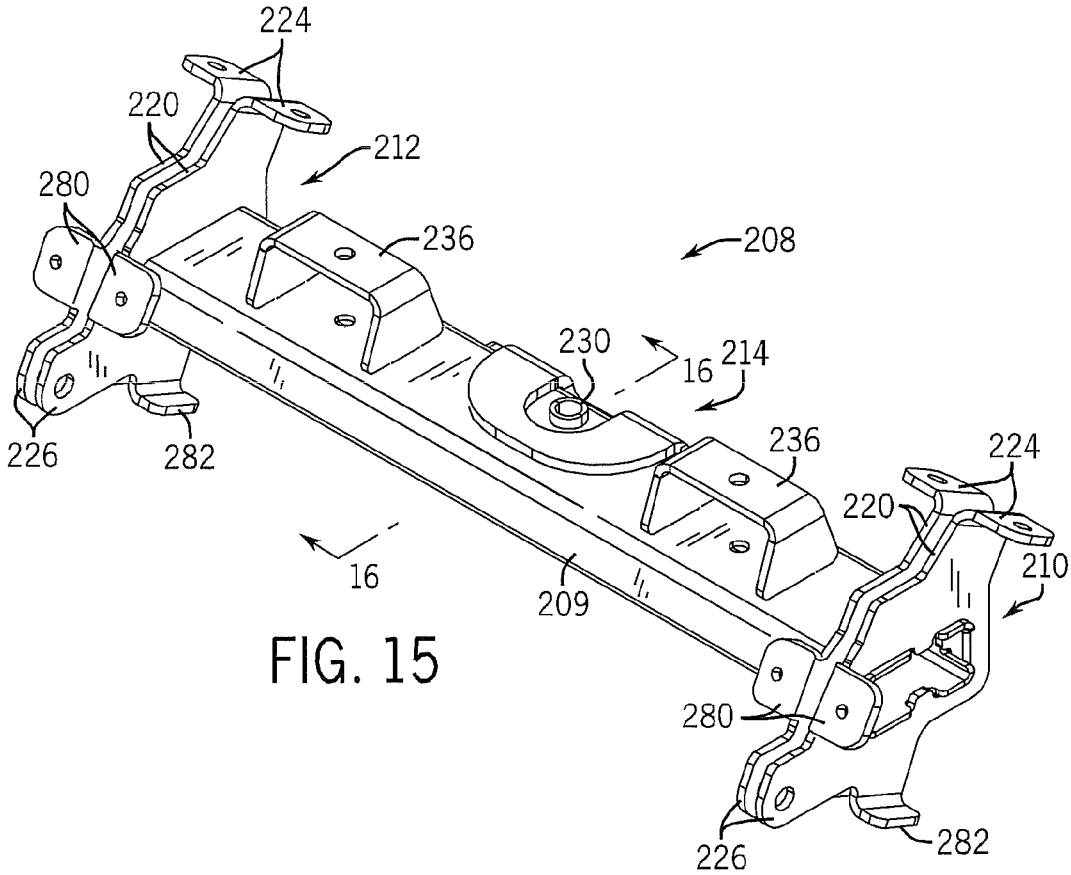
FIG. 15. is an isometric, front view of an exemplary embodiment of a swing frame of the hitch mechanism illustrated in FIG. 3.
Figure 17B:
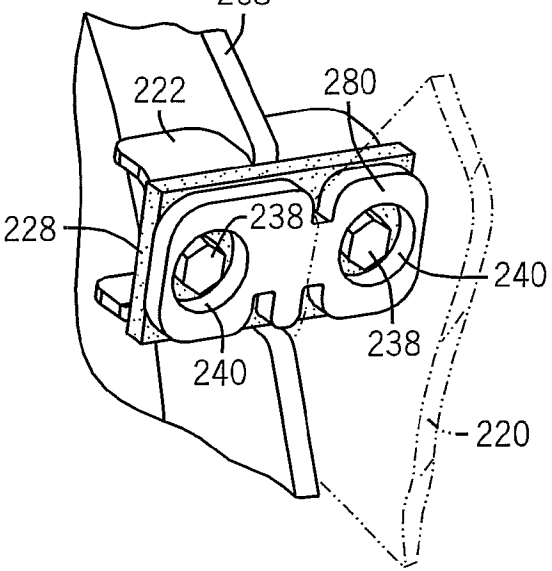
FIG. 17B is an isometric, rear view of an exemplary embodiment of a cushion block coupled to the blade illustrated in FIG. 18, with a portion of the swing frame in phantom.
Figure 16:
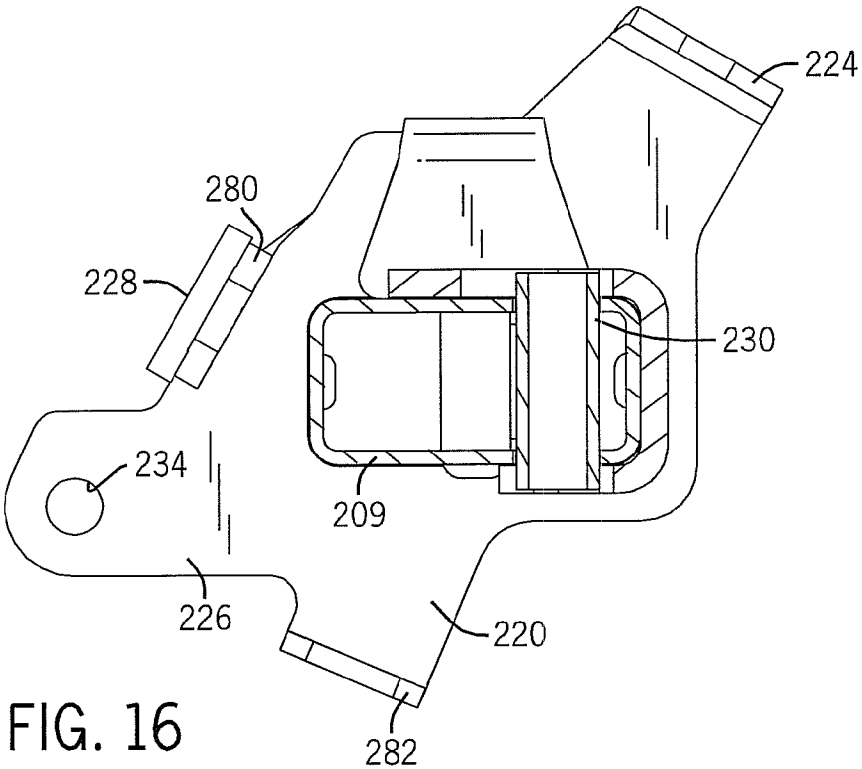
FIG. 16 is a cross sectional view of the swing frame illustrated in FIG. 15 along the line 16-16.
Figure 17:
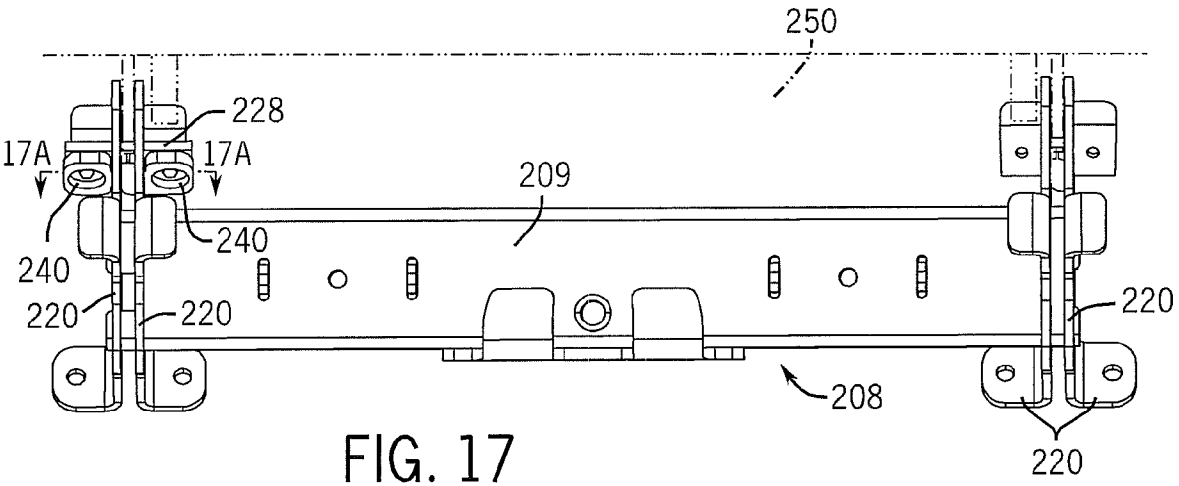
FIG. 17 is bottom view of the swing frame illustrated in FIG. 15.
Figure 17A:
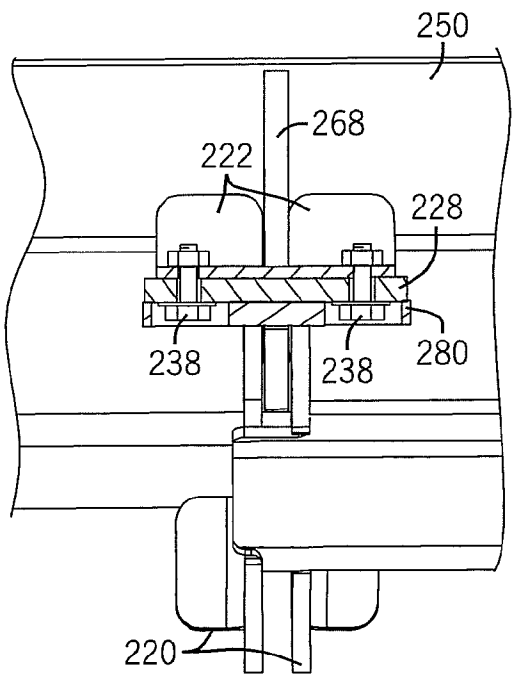
FIG. 17A is a partial cross-sectional top rear view of a cushion block assembly along the line 17A-17A of FIG. 17.
Figure 18:
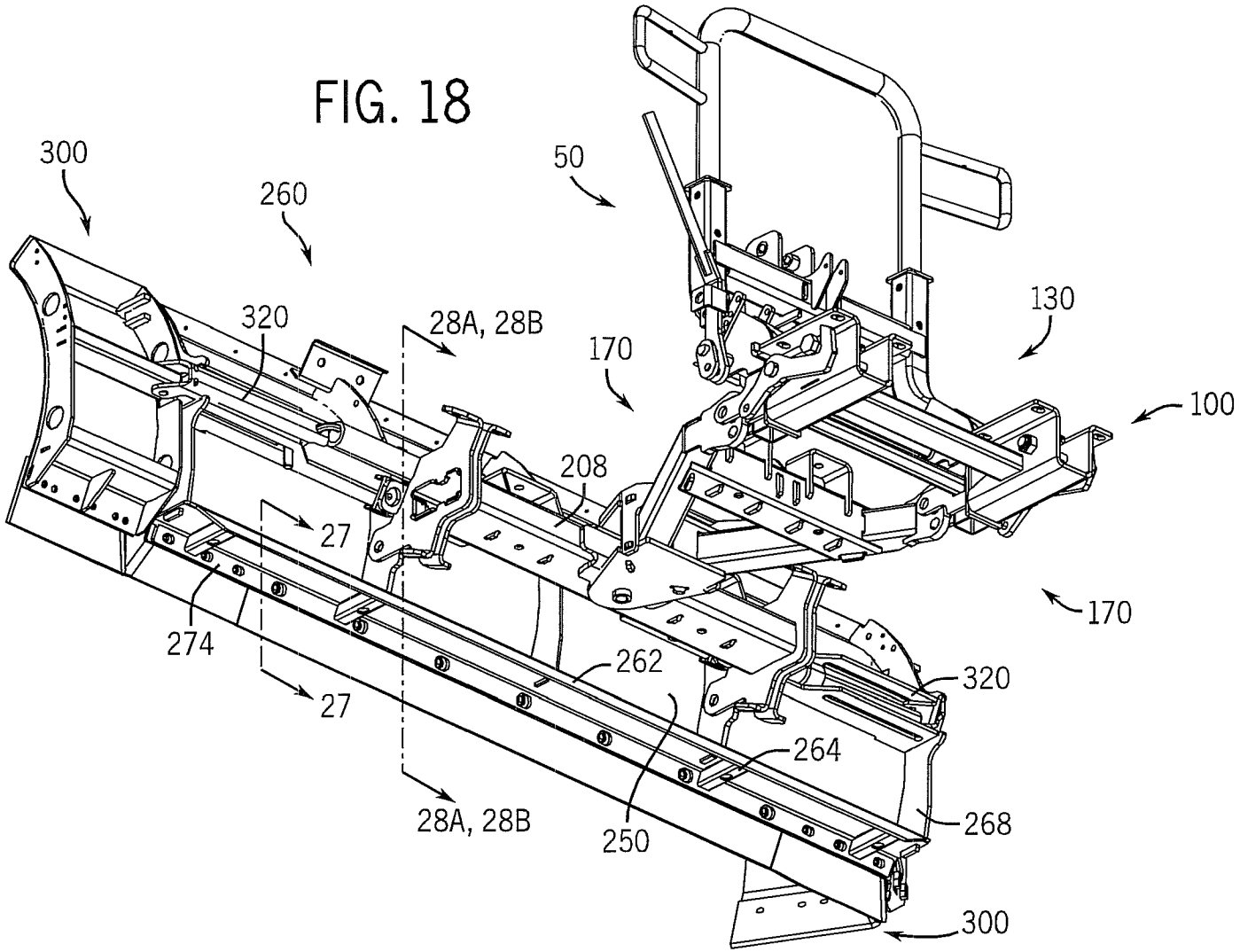
FIG. 18 is an isometric, back view of an exemplary embodiment of a blade coupled to the hitch mechanism illustrated in FIG. 3, the blade including a wing blade on each blade end.

A swing frame 208 is pivotally coupled to the swing frame pivot assembly 184 of the plow frame 170 (see at least FIGS. 15 and 18). The swing frame 208 includes a swing frame tube 209 which has two swing frame ends 210 and 212. Coupled to each swing frame end 210, 212 is a pair of trip spring brackets 220. (See FIGS. 15 and 17.) Each trip spring bracket 220 includes a trip spring mount 224, a cushion trip plate 280 and a blade pivot mount 226. Each pair of trip spring brackets 220 are coupled to the swing frame tube 209, for example by welding.

The swing frame 208 includes a pivot 230 positioned in a center portion 214 of the swing frame tube 208. The pivot 230 couples to the swing frame pivot assembly 184 of the plow frame 170 with the swing frame pivot pin 190.

The swing frame tube 109 also supports a pair of swing cylinder mounts 236 mounted on the swing frame tube 209 with each swing cylinder mount 236 positioned between the center portion 214 of the swing frame tube 209 and one end 210, 212 of the swing frame tube 209. (See FIG. 15.) A swing cylinder 252 is coupled at one end to a swing cylinder mount 236 on the swing frame 208 and on another end on the swing cylinders mounts 202, 204 of the plow frame 170. The swing cylinder 252 as selectively operated by a user of the snow plow 50 can rotate the central plow blade 250 about the pivot 230. The degree of rotation of the plow blade relative to the plow frame 170 is established by the extension capabilities of the swing cylinders 252 as selected by an operator.

The central plow blade 250 is coupled to the swing frame 208 pinning the plow blade to each of the trip spring brackets 240 at the blade pivot mount 226 on each of the trip spring brackets 220. A pivot pin is received in a pivot aperture 234 and is typically secured in place by a cotter pin (not shown). It is contemplated that other means of fastening the pivot pin can be used such as a bolt and nut.

Figure 23:
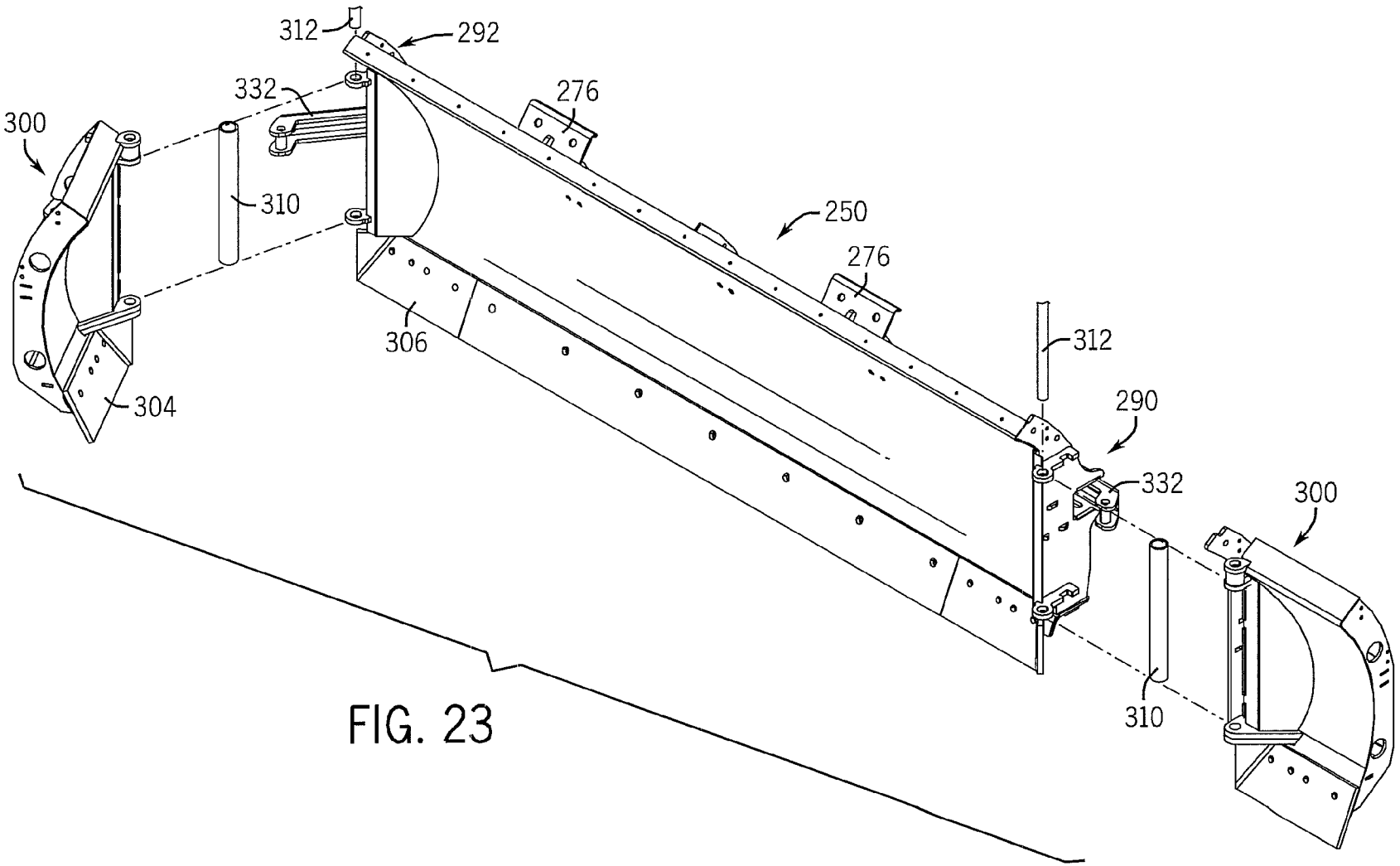
FIG. 23 is an exploded front view of blade illustrated in FIG. 20, showing one wing blade in the straight position relative to the plow blade and another wing blade in the folded position relative to the plow blade.

As illustrated in FIG. 15, also coupled to the trip spring bracket 220 is a cushion trip plate 280 The cushion trip plate 280 is configured with a pair of oversize bolt apertures 240 to accommodate a socket or other tool for manipulating a cushion bolt 238 to secure a cushion block 228 to the cushion mount 222. The cushion block 228 is substantially a rectangular shaped block of polyurethane or other high density resilient material. The cushion block 228 is used to absorb the impact of the plow blade 250 (see FIGS. 23A and 23B) as the plow blade moves between its limits. Such movement of the plow blade 250 is caused by the central plow blade 250 striking an object as the plow blade 250 is moved by a vehicle. The cushion block 228 is configured to prevent damage to the snow plow by allowing the snow central plow blade 250 to "trip" that is, for the bottom of the central plow blade 250 to move rearward and the top of the central plow blade 250 to simultaneously move forward about the blade pivot pin, resulting in a rotation of plow blade 250 around a horizontal axis. It should be understood that the forward and rearward directions of blade movement are relative to an associated vehicle's direction of movement. Such a rotation is inhibited by trip springs 284 which act as a shock absorber mechanism, and which return the central plow blade 250 to a normal or "trip return" position. The springs 284 are relatively strong, since they must prevent the plow blade from rotating when it is plowing snow and the metal-to-metal impacts of both a trip spring bracket and a plow blade can be substantial. The cushion block 228 is configured to cushion the impacts on both the blade and the trip spring bracket 220.

It is also contemplated that a back cushion (not shown) similar to the cushion block 228 can be coupled, for example by bolting, to a blade stop 282 at a lower end of each of the trip spring brackets 220. The back cushion is configured to ameliorate vibration and damage to the central plow blade 250 if the plow blade contacts an obstruction during operation.

The cushion block 228 is rectangular in shape and provides a relatively large area to distribute the force exerted upon the cushion block 228 when the blade 250 moves back to its trip return position by action of the trip springs 284. The relatively large cushion bolt aperture 240 allows a user to easily access the cushion bolts 238 when servicing the cushion block. Servicing of the cushion block 228 can be accomplished, for example, replacing the cushion block 228 without having to remove the central plow blade 250 from the swing frame 208. However, a slight forward rotation of the central plow blade 250 must be provided to remove the cushion block from between the cushion mount 222 and the cushion trip plate 280.

The process of replacing a worn out cushion block 228 without removing the central plow blade 250 from the swing frame 208 can be accomplished as follows.

First, one removes the cushion bolts 238 out of the cushion block 228 by way of the bolt apertures 240 defined in the cushion trip plate 280. Next, one rotates the top portion of the plow blade 250 forward. The worn out cushion block 228 can then be removed and a new cushion block 228 can be put in its place. One then allows the top portion of the plow blade 250 to rotate backward until the cushion trip plate 280 and cushion mount 222 both are in contact with the cushion block 228. The cushion bolts 238 are then reinserted through the bolt apertures 240 and the cushion block 228 is coupled to the cushion mount 222 and secured in place.

A wing wear strip 304 is coupled to a wing blade 300. A wing wear strip 306 is also coupled to the central plow blade 250. Each of the wing wear strip 304, 306 are configured with an angled facing portion that that meet in the front side when the wing blade 300 is in the second or folded position and meet in the back side when the wing blade 300 is in the first or straight position. (See FIGS. 19-22A.) The wear strips 304, 306 are coupled to the wing blade 300 and the central plow blade with bolts or other suitable fasteners.

Referring now to FIGS. 18-28B, FIG. 18 illustrates a snow plow 50 with a plow blade assembly 260 coupled to a quick connect/disconnect hitch 70. FIG. 18 is a bottom, rear isometric view of the snow plow 50.

Figure 20:
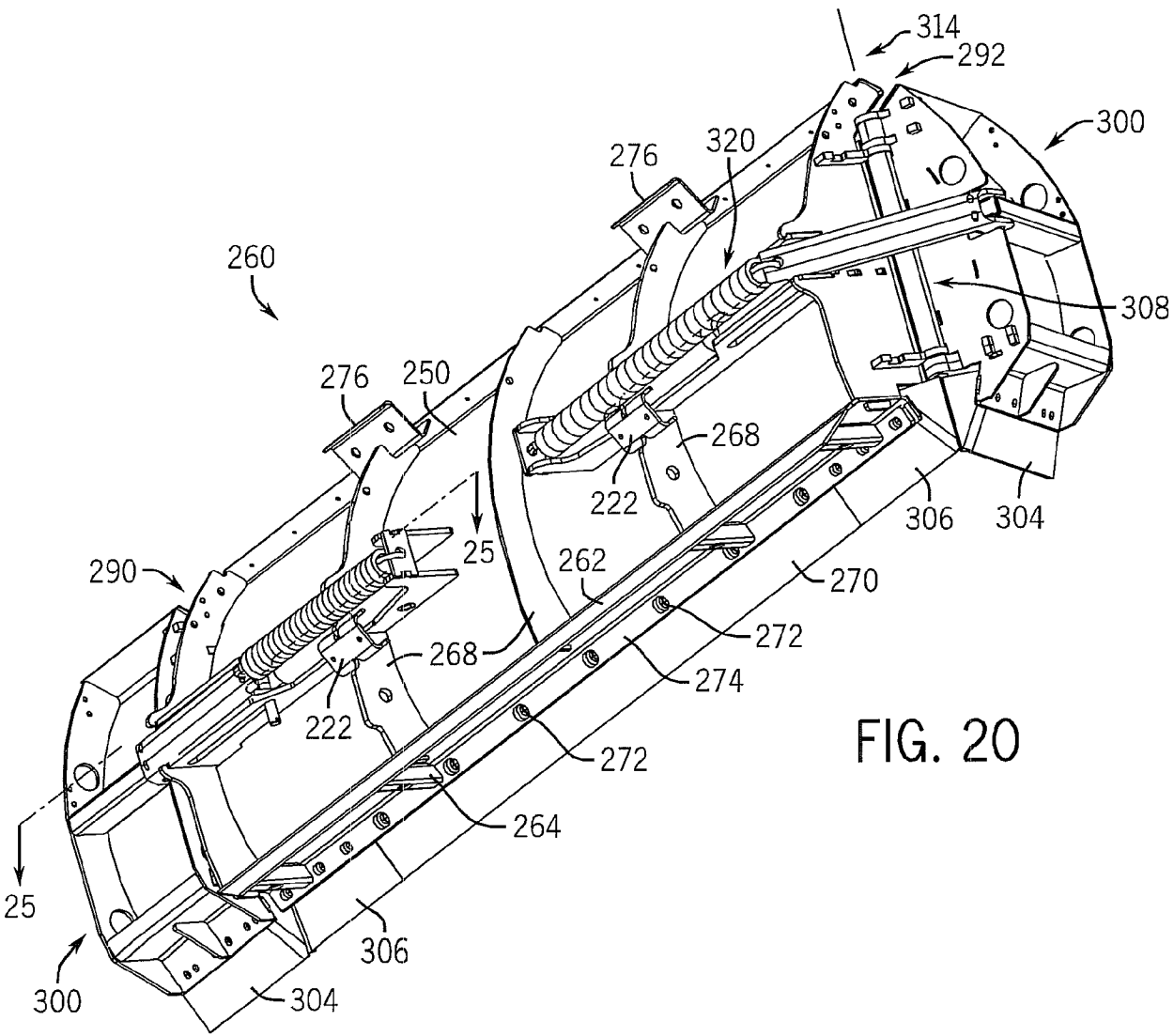
FIG. 20 is an isometric, bottom rear view of the blade illustrated in FIG. 18.

FIG. 20 is an isometric rear view of the plow blade assembly 260. The central plow blade 250, is coupled, for example, by welding, to a plurality of plow ribs 268. Each of the plow ribs 268 are aligned vertically and coupled to a bottom plow frame member 262. The plow ribs 268 are positioned at evenly spaced intervals along the bottom plow frame member 262 and welded to the plow blade 250 and the bottom plow frame member 262. Each of the plow ribs 268 is configured in a concave curve to which the central plow blade 250 conforms and which also facilitates movement of material such as snow as the plow 50 is operated. A wear strip 270 is coupled to a substantial portion of the lower edge of the plow blade 250 by a plurality of bolts 272 which extend through the wear strip 270, the central plow blade 250, the bottom plow frame member 262 and a nut plate 274 which is positioned against one of the downward extending flanges of the bottom plow frame member 262. (See at least FIG. 20.) Reinforcement members 264 are positioned between the down facing flanges of the bottom plow frame member to reinforce the plow blade assembly 260. The reinforcement members 264 are typically welded to the bottom plow frame member 262. The top edge of the plow blade 250 is bent and configured to be coupled to the top edge of each of the plow ribs 268. The top edge of the plow blade 250 is typically welded to each of the plow ribs 268.

Referring to FIG. 20 for example, a pair of plow trip spring brackets 276 are coupled, for example, by welding, each to a plow rib 268. The plow trip spring brackets 276 are aligned with the trip spring mounts 224 on each of the spring brackets 220 coupled to the swing frame 208. A cushion mount 222 is also coupled, typically by welding, to each of the plow ribs 268 that support the plow trip spring brackets 276 (see FIG. 24). A cushion block 228 is bolted to each of the cushion mounts 222 and is configured and aligned to contact a cushion trip plate 280 (see FIG. 28A) coupled to each of the trip spring brackets 220.

Figure 19:
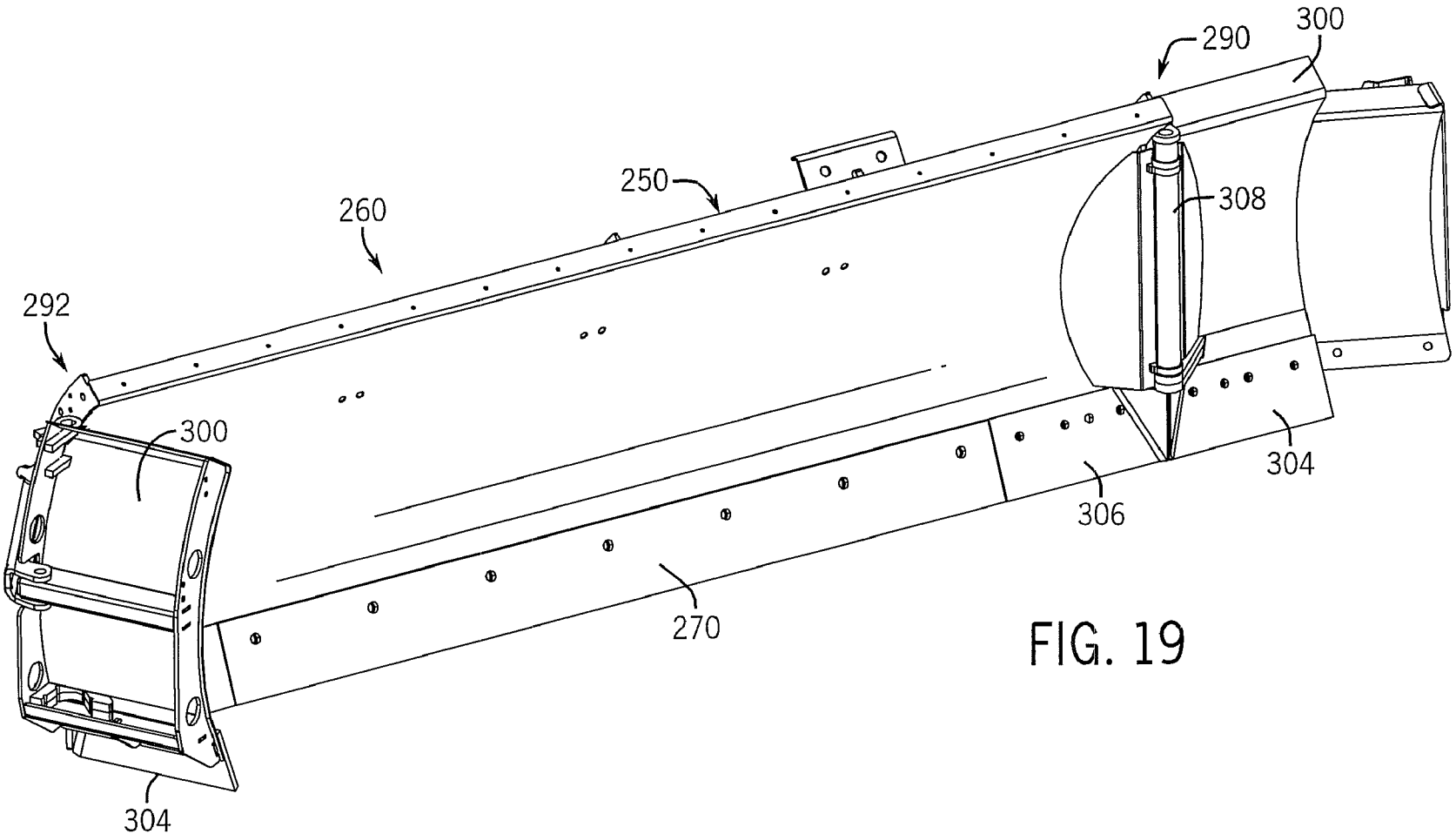
FIG. 19 is an isometric, front view of the blade illustrated in FIG. 18, showing one wing blade in a straight position and another wing blade in a folded position, the wing blade in the straight position also includes a blade extension member.

FIG. 19 illustrates a front perspective view of a plow blade assembly 260 which includes a central plow blade 250 and a pair of wing blades 300. A wing blade 300 is pivotally coupled to each end 290, 292 of the central plow blade 252. In FIG. 19, one of the wing blades 300 is aligned in a straight aspect with the central plow blade 250 and the other wing blade 300 is in a folded or second position towards the front of the central plow blade 250 in excess of 90 degrees from the straight or first position.

FIG. 20 is an isometric bottom rear view of the blade assembly 260. Each of the wing blades 300 is coupled to the central plow blade 250 about a vertical axis 314 which is parallel with each of the first 290 and second 292 ends of the central plow blade 250. Each of the wing blades 300 is coupled to an actuation mechanism 320 mounted at the rear of the central plow blade 250.

Figure 21:
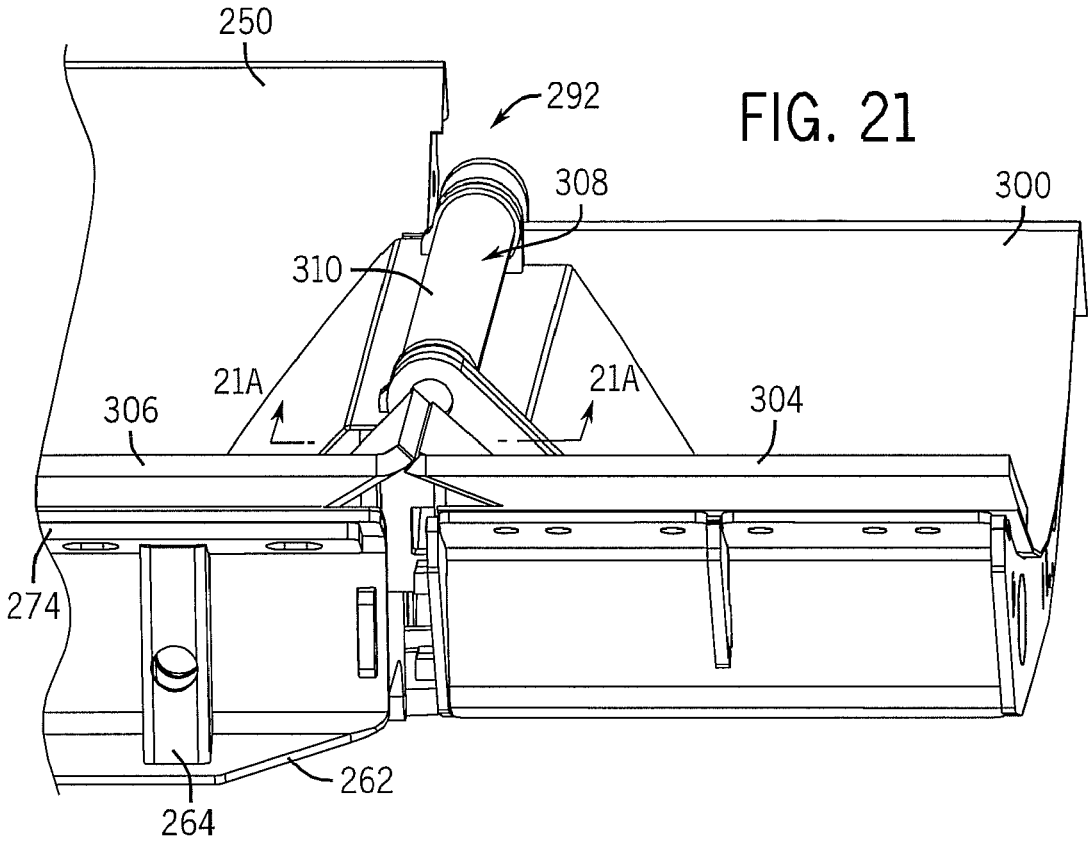
FIG. 21 is an isometric, bottom detail view of the wing blade in the straight position of the blade illustrated in FIG. 20.
Figure 21A:
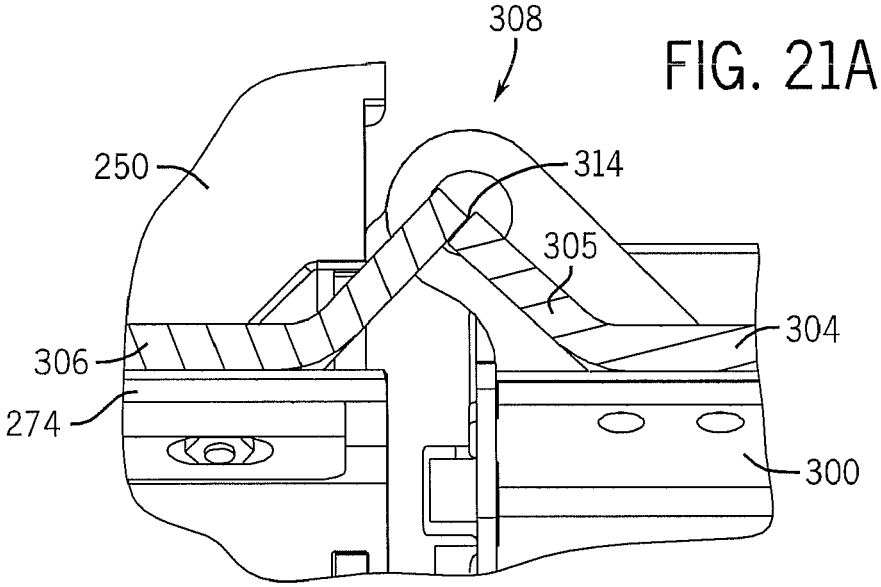
FIG. 21A is a partial cross-sectional view of the wing blade illustrated in FIG. 21 along the line 21A-21A.

Referring now to FIGS. 21 and 21A, a wing blade 300 is illustrated in a first position which is longitudinally aligned in line or straight with the central plow blade 250. A wing pivot 308 houses a wing pivot pin 312 in a wing pivot tube 310. The wing pivot tube 310 can be coupled to one of the central plow blade 250 and wing blade 300. The wing pivot tube 310 can be welded to one of the central plow blade 250 or wing blade 300 or it can be fabricated in conjunction with the fabrication of either the central plow blade 250 and wing blade 300.

As shown in FIG. 21A, a portion of the central plow blade 250 and a portion of the wing blade 300 meet at approximately a vertical axis 314 of the wing pivot 308. Such configuration inhibits material, such as snow, from moving between the central plow blade 250 and wing blade 300. As configured, there is very little gap between the central plow blade 250 and the wing blade 300 throughout the vertical axis 314 between the central plow blade 250 and the wing blade 300.

Figure 22:
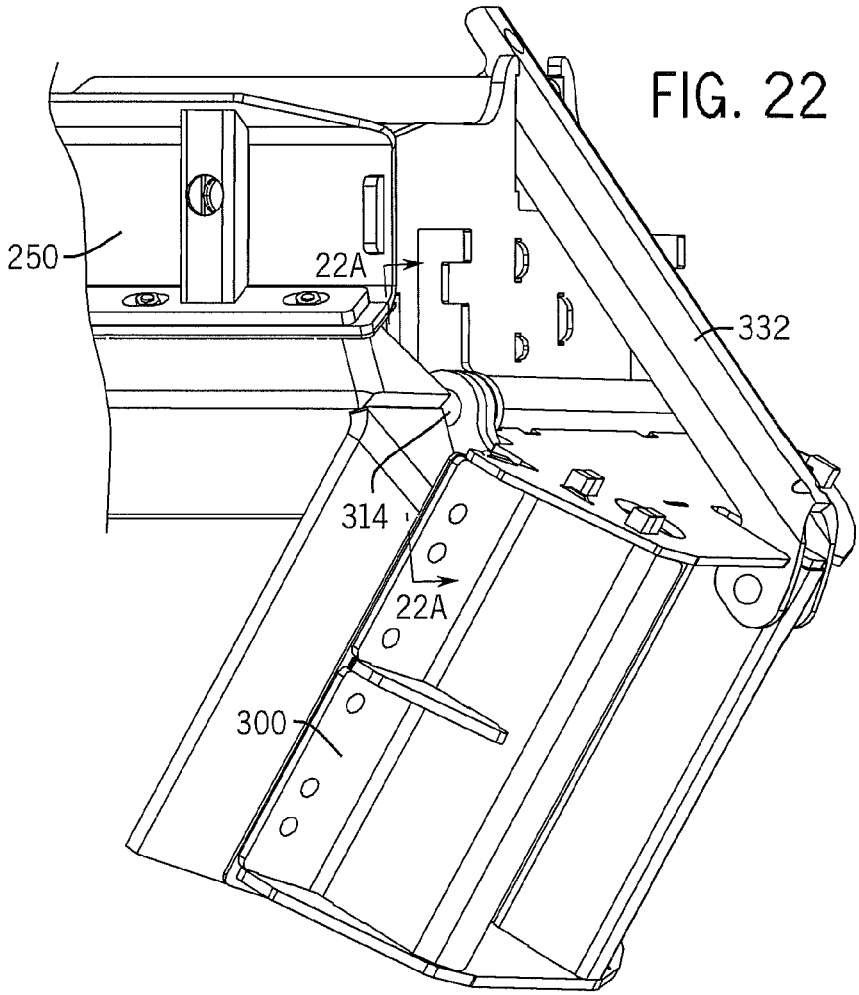
FIG. 22 is an isometric, bottom detail view of the wing blade in the folded position of the blade illustrated in FIG. 20.
Figure 22A:
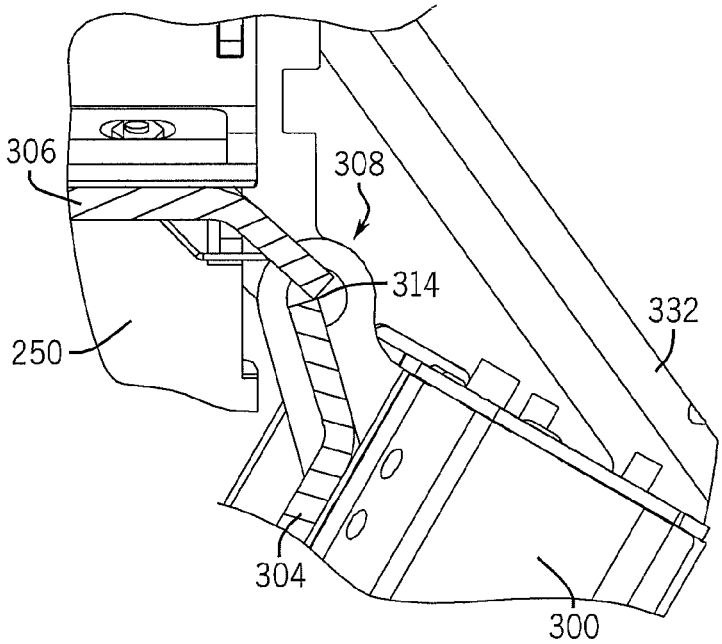
FIG. 22A is a partial cross-sectional view of the wing blade illustrated in FIG. 22 along the line 22A-22A.

FIGS. 22 and 22A illustrate a wing blade 300 moved into a second or folded position about the vertical axis 314 which is substantially parallel to the end 290, 292 of the central plow blade 250. As shown in FIG. 22A, a portion of the central plow blade 250 and a portion of the wing blade 300 maintain their approximate position on the vertical axis 314 of the wing pivot 308 throughout the movement of the wing blade 300 from the first position (straight) to the second position (folded) about the vertical axis 314 which is parallel with each of the first and second ends 290, 292 of the central plow blade 250.

Referring now to FIGS. 23, 24, 25, and 26, an actuation mechanism 320 will be described. A pair of actuation mechanisms 320 are coupled to the plow blade assembly 260 to facilitate movement of the wing blade 300 from the first position relative to the central plow blade 250.

Figure 24:
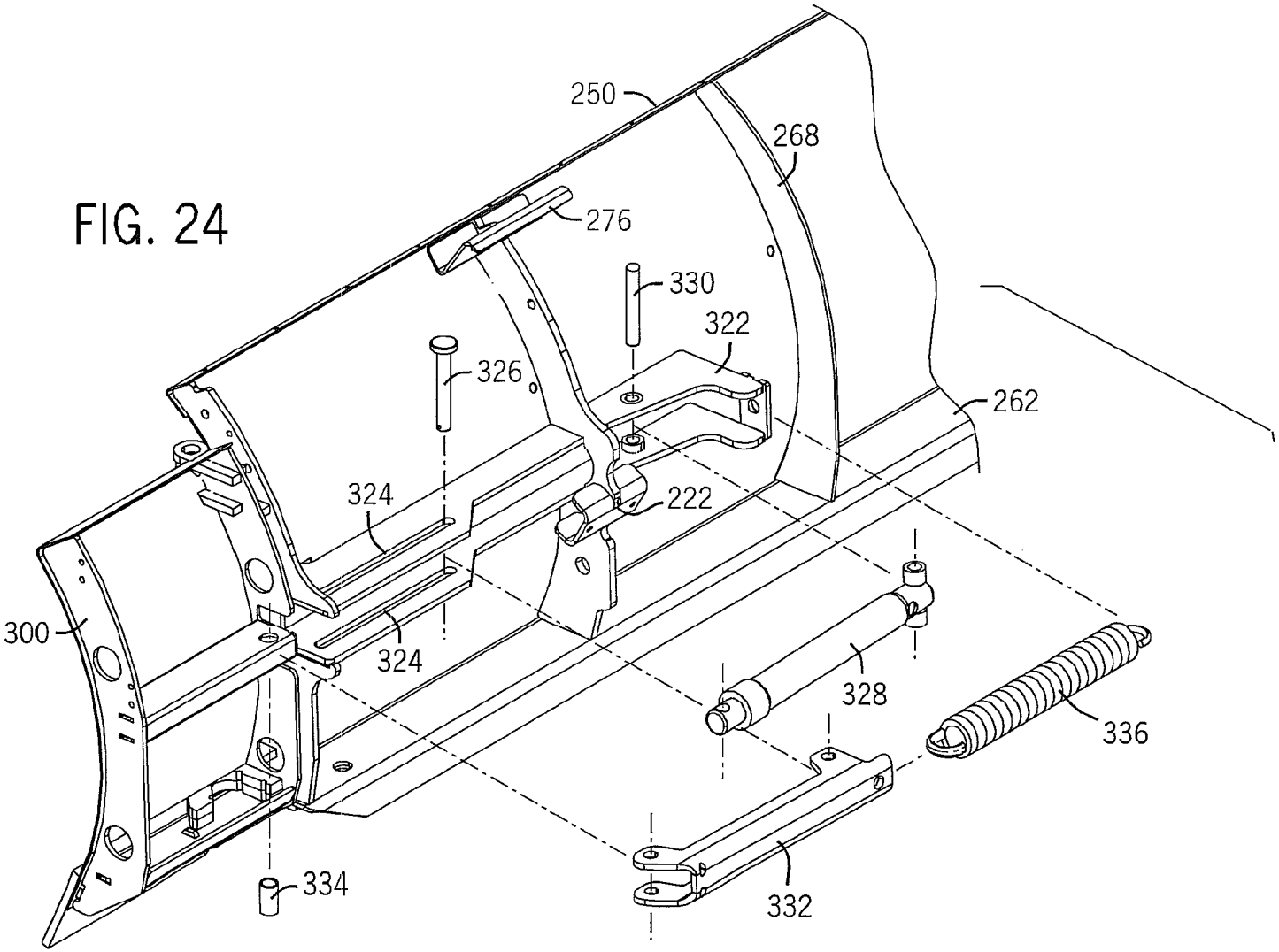
FIG. 24 is an exploded view of an exemplary embodiment of a wing blade including an actuation mechanism for the wing blade.

Each actuation mechanism 320 includes an actuation bracket coupled to the central plow blade 250 (see FIG. 24). The preferred embodiment of the actuator bracket 320 is a steel, unshaped channel which defines a guide slot 324 in a portion of actuator bracket 322 that is approximate an end 290, 292 of the central plow blade 250. Coupled to the actuator bracket 322 is a wing actuator cylinder 328. The wing actuator cylinder 328 is coupled to the actuator bracket 322 at one end by a pivot pin 330 and at another end with a guide pin 326 slidingly engaged in the guide slot 324. A return spring 336 is coupled at one end to the actuator bracket 322 and to a wing actuator rod 332. The wing actuator rod 332 is also coupled to the actuator bracket 322 at one end by the guide pin 326 within the actuator bracket 322 and is also coupled to the return spring 336 and the wind actuator cylinder 328. Another end of the wing actuator rod 332 is pivotally coupled to the wing blade 300 by a pivot pin 334.

Figure 25:
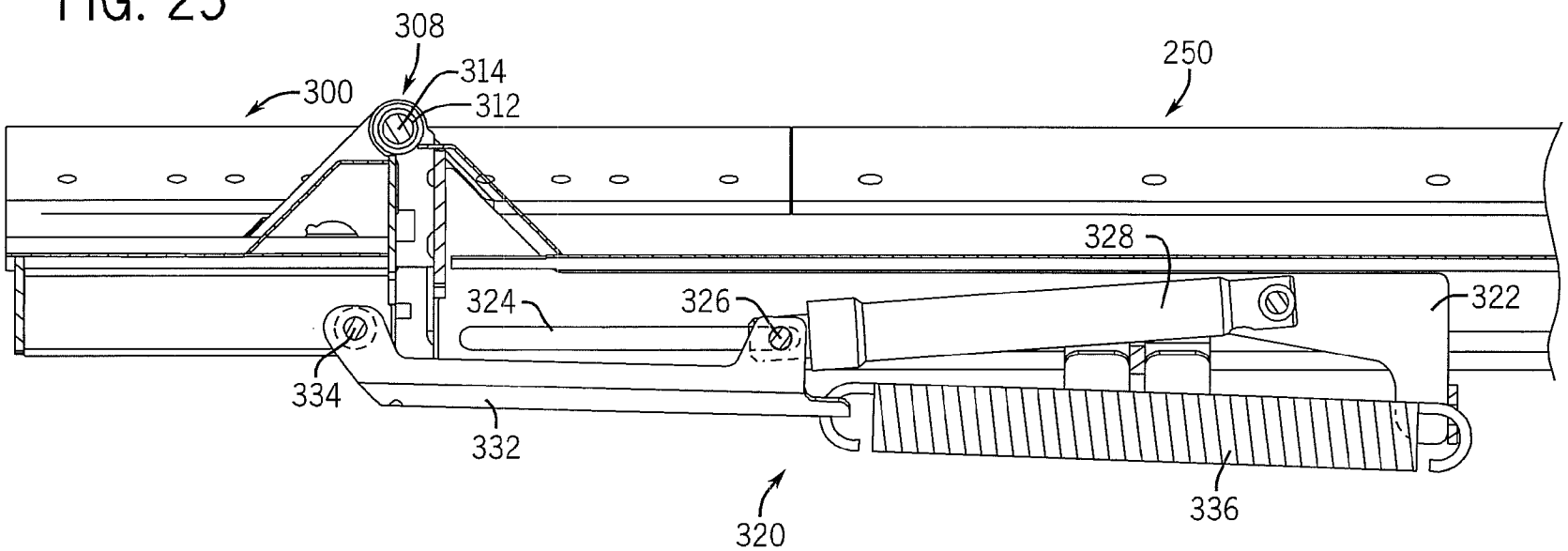
FIG. 25 is a top view of the blade illustrated in FIG. 18, showing the wing actuation mechanism in a straight position.

FIG. 25 illustrates exemplary embodiment of an actuator mechanism 320 configured with the wing blade 300 and the central plow blade 250 in a straight or first position configuration.

Figure 26:
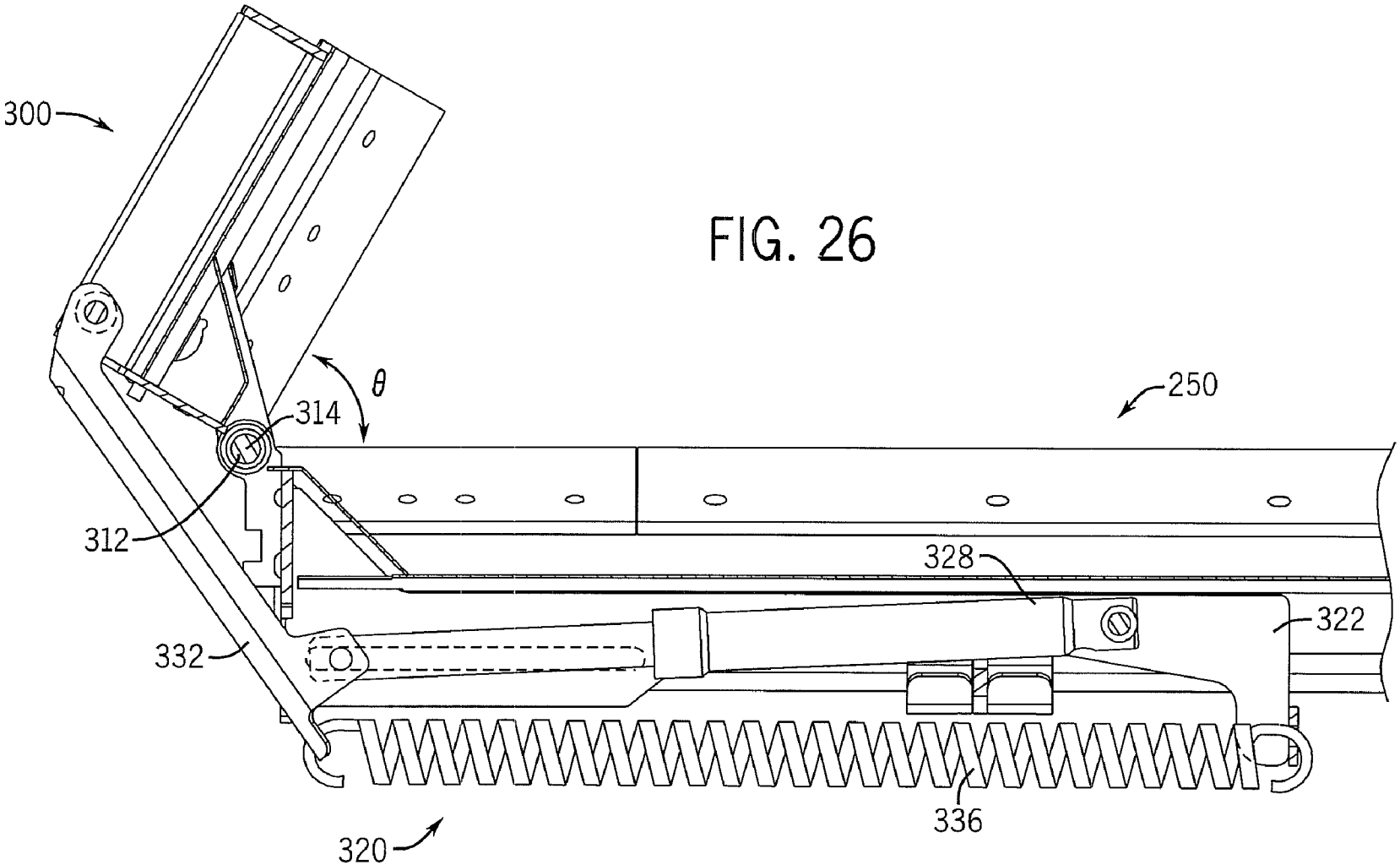
FIG. 26 a top view of the blade illustrated in FIG. 18, showing the wing actuation mechanism in a folded position.
Figure 27:
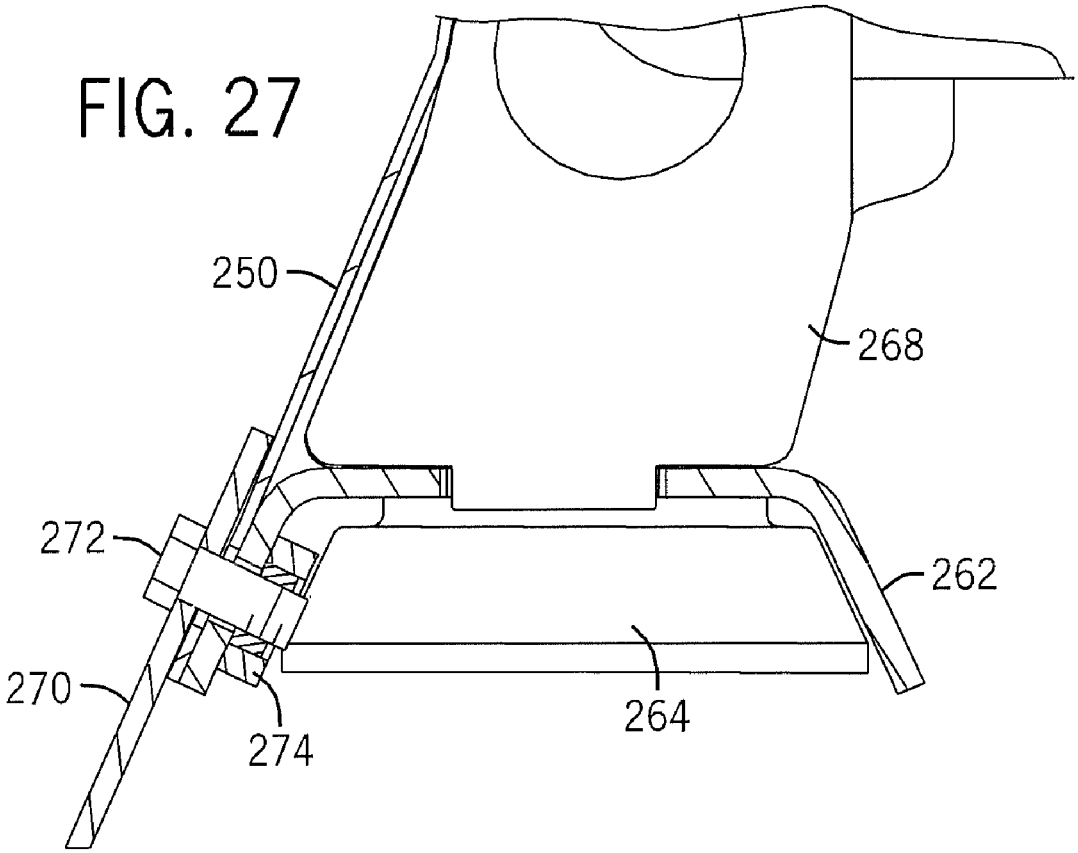
FIG. 27 is a partial cross sectional view of the bottom of the blade illustrated in FIG. 18 along the line 27-27, showing how a blade cutting edge, nut plate, moldboard and wear strip are coupled to a blade frame member.
Figure 28A:
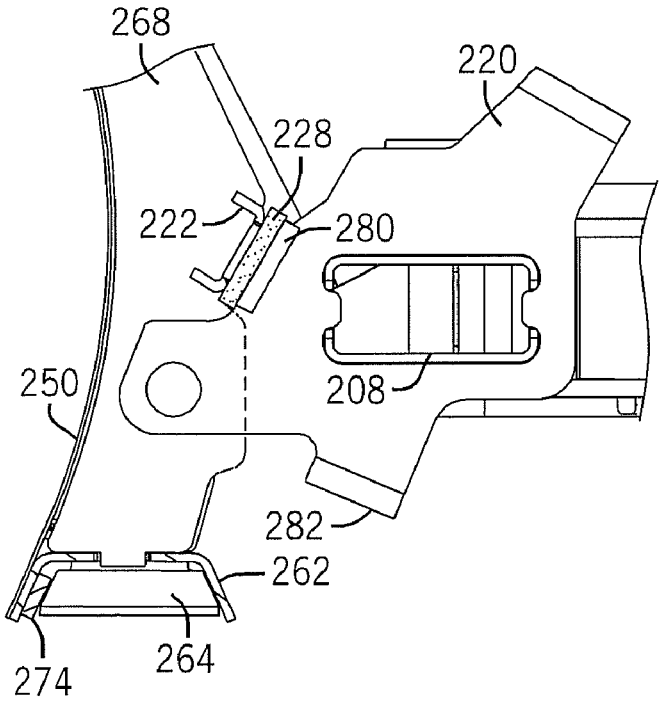
FIG. 28A is a partial cross-sectional view along the line 23A-23A of FIG. 18 showing the plow blade in a normal position.
Figure 28B:
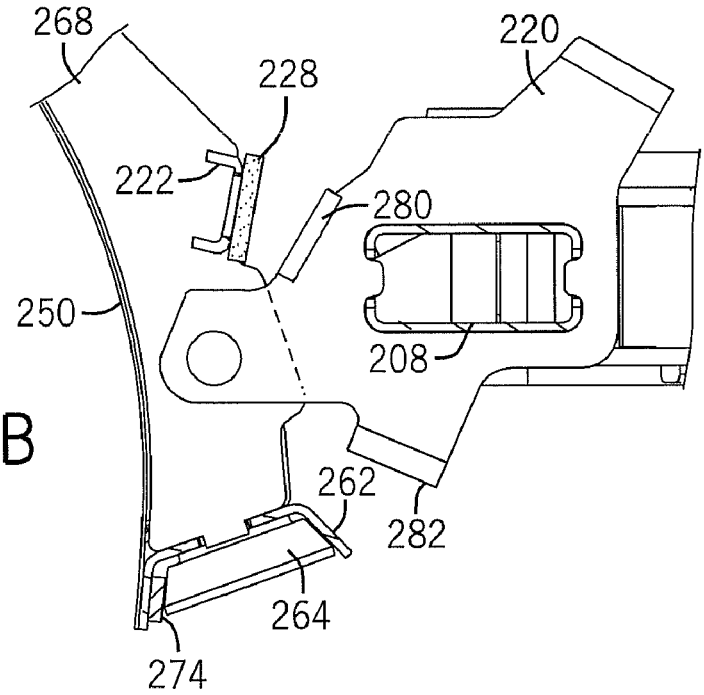
FIG. 28B is a partial cross-sectional view the plow blade illustrated in FIG. 28A showing the plow blade in a rotated position.

FIG. 26 illustrates an actuator mechanism 320 with a wing blade 300 and central plow blade 250 configured in a second or folded position. As shown in FIG. 26, the wing blade in the second position has moved more than 90 degrees about the vertical axis 314 relative to the central plow blade 250 thereby forming an angle • between the front edge of the wing blade 300 and the front edge of the central plow blade 250 of approximately 60 degrees. In other words, the wing blade 300 was moved approximately 120 degrees about the vertical axis 314 by the actuator mechanism 320. It should be understood that the movement of the wing blade 300 is infinitely variable.

Each of the wing blades 300 can be moved, by a user of the plow 50 independent of each other and independent of the central plow blade 250. In other words, the position of the wing blade 300 is not dependent upon the position of the central plow blade 250 or the other wing blade on the opposite end of the plow blade 250. In operation, the user of the plow 50 can configure the plow assembly 260 in any position suitable for the type of material such as snow and terrain in which the plow is being operated. One convenient configuration of the plow blades is to have each of the wing blades 300 move to their second position during movement of the plow and hitch to the worksite. It should also be understood that the wing blade can be fitted with a blade extension which would further extend the reach of the wing plow in a typical horizontal aspect.

Figure 29:
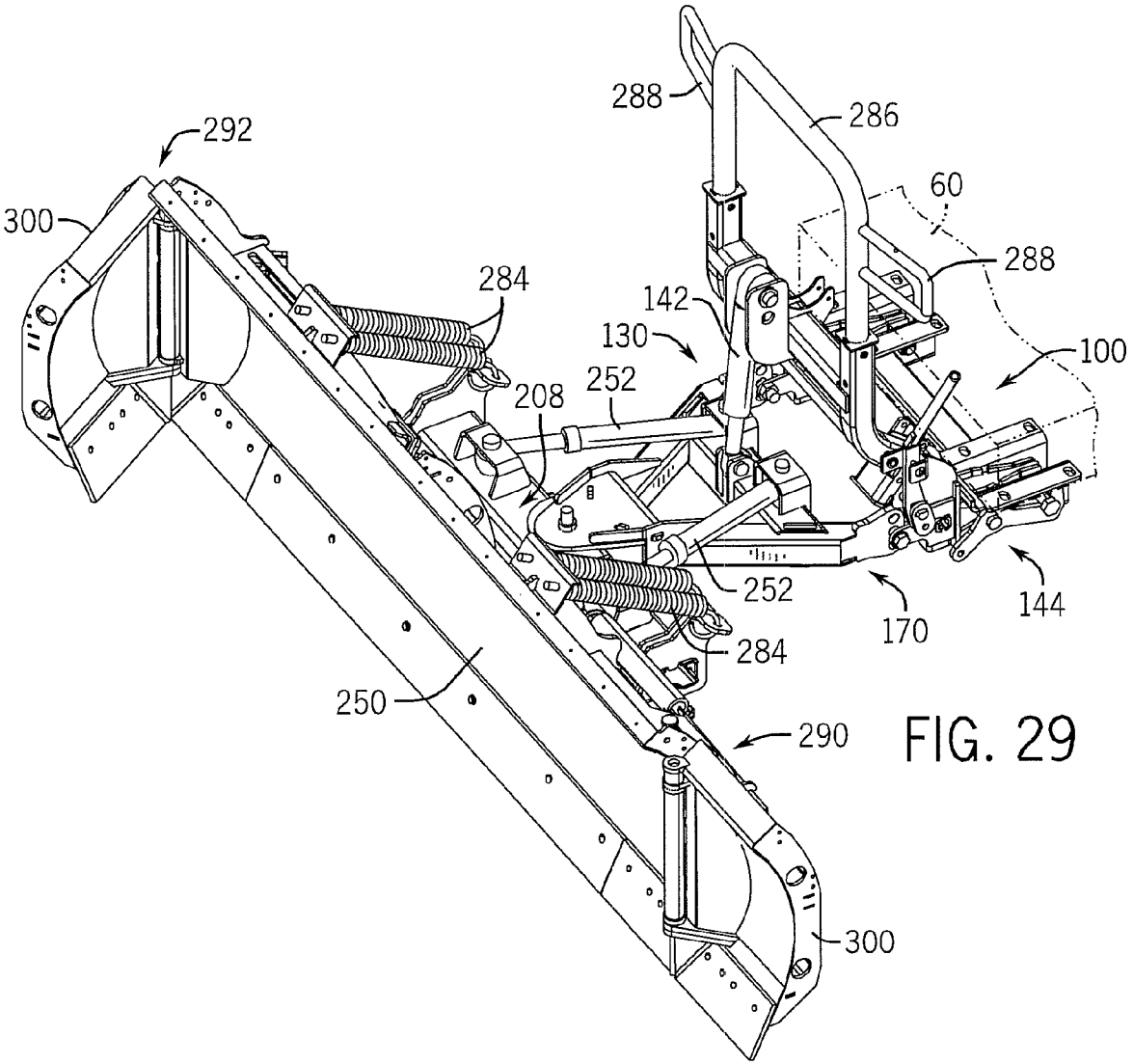
FIG. 29 is an isometric, assembly view of an exemplary embodiment of the blade illustrated in FIG. 18 and the hitch mechanism illustrated in FIG. 3 coupled together.

As illustrated in FIG. 29, a plurality of trip springs 284 are coupled to each of the plow trip spring brackets 276 and the trip spring brackets 220. FIG. 29 also illustrates a light bar 286 coupled to the lift bar support brackets 132. The light bar 286 supports a plurality of light brackets 288 to which plow lights (not shown) are coupled. Plow lights are typically needed since the snow plow 50 typically obstructs the headlights of the vehicle to which the snow plow 50 is coupled.

For purposes of this disclosure, the term "coupled" means the joining of two components (electrical or mechanical) directly or indirectly to one another. Such joining may be stationary in nature or moveable in nature. Such joining may be achieved with the two components (electrical or mechanical) and any additional intermediate members being integrally formed as a single unitary body with one another or the two components and any additional member being attached to one another. Such adjoining may be permanent in nature or alternatively be removable or releasable in nature.

Although the foregoing description of a quick connect/disconnect hitch and a plow with independently moveable wings has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the hitch or plow as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. A snow plow rebound apparatus for a snow plow, comprising a snow plow blade, having a plowing side and a non-plowing side, and configured to partially rotate about a horizontal axis, coupled to a snow plow frame that is coupled to a snow plow mounting apparatus, wherein the snow plow blade, snow plow frame and snow plow mounting apparatus are protected from damage due to rotation of the snow plow blade about the horizontal axis, the snow plow rebound apparatus comprising:

a plurality of plow trip spring brackets coupled to the non-plowing side of the snow plow blade;

a plurality of trip springs having first and second ends, with the first ends coupled to the plow trip spring brackets;

a plurality of trip spring brackets, including a plurality of trip spring mounts and a plurality of cushion trip plates, the trip spring brackets coupled to the snow plow frame, the second ends of the springs coupled to the trip spring mounts; and a plurality of cushion mounts coupled to the non-plowing side of the snow plow blade and a plurality of cushion blocks coupled to the cushion mounts, wherein the cushion blocks are configured to contact the cushion trip plates when the portion of the snow plow blade above the horizontal axis of rotation rotates towards the snow plow frame about the horizontal axis.

2. The snow plow rebound apparatus of claim 1, wherein the trip springs are configured to draw the top of the snow plow blade towards the snow plow frame around the axis of horizontal rotation when the top of the snow plow blade rotates forward around the horizontal axis of rotation.

3. The snow plow rebound apparatus of claim 1, wherein the trip springs are configured to hold the snow plow blade rotationally in place when the snow plow blade is plowing snow.

4. The snow plow rebound apparatus of claim 1, wherein the trip springs are configured to absorb a shock which may tend to rotate the top of the snow plow blade forward, away from the snow plow mounting apparatus, around the horizontal axis of rotation.

5. The snow plow rebound apparatus of claim 1, wherein the cushion trip plates define at least one bolt aperture.

6. The snowplow rebound apparatus of claim 1, wherein the cushion blocks are positioned between the snow plow blade and the snow plow frame;

the cushion blocks are configured to prevent the snow plow blade from contacting the snow plow frame or the snow plow mounting apparatus; and the cushion blocks are configured to absorb the force of the snow plow travelling toward the snow plow frame and the snow plow mounting apparatus.

7. The snow plow rebound apparatus of claim 1, wherein the cushion blocks are configured to prevent damage to the snow plow blade, the snow plow frame, and the snow plow mounting apparatus.

8. The snow plow rebound apparatus claim 1, wherein each cushion block is rectangular in shape and composed of a high density resilient material.

9. The snow plow rebound apparatus of claim 8, wherein the high density resilient material is polyurethane.

10. The snow plow rebound apparatus of claim 1, wherein each cushion block is configured to be removed and replaced while the snow plow blade is coupled to the snow plow frame and the snow plow frame is coupled to the snow plow mounting apparatus.

11. A method of cushioning a snow plow, the snow plow including a snow plow blade, configured to partially rotate about a horizontal axis from a first, vertical configuration to a second, non-vertical configuration and having a plowing side and a non-plowing side, coupled to a snow plow frame coupled to an apparatus for connecting the snow plow to a vehicle, the method comprising:

coupling a first end of a plurality of trip springs to the non-plowing side of the snow plow blade and coupling a second end of the trip springs to the snow plow frame, the springs configured to bias the snow plow blade against rotating about the horizontal axis; and coupling a cushion block to the non-plowing side of the snow plow blade, positioning the block between the snow plow blade and the snow plow frame, wherein when the snow plow blade rotates from the first, vertical configuration to the second, non-vertical configuration, the trip springs tend to resist this rotation, and wherein the cushion block is configured to absorb the impact between the snow plow blade and snow plow frame when the trip springs return the snow plow blade from the second, non-vertical configuration to the first, vertical configuration.

12. The method of claim 11, further comprising, using at least one additional cushion block spaced a distance apart from the other cushion block.

13. The method of claim 12, further comprising, positioning the cushion blocks on the non-plowing side of the snow plow blade to prevent the snow plow blade from contacting one of the snow plow frame and the apparatus for connecting the snow plow to the vehicle; and locating the cushion blocks to absorb the force of the snow plow blade travelling toward the snow plow frame and the apparatus for connecting the snow plow to the vehicle.

14. The method of claim 11, wherein the cushion block is rectangular in shape and composed of a high density resilient material.

15. The method of claim 14, wherein the high density resilient material is polyurethane.

16. The method of claim 11, wherein the cushion block is configured to be removed and replaced while the snow plow blade is coupled to the snow plow frame and the snow plow frame is coupled to the snow plow mounting apparatus.

17. A snow plow, comprising:

a snow plow blade having a non-plowing side and a plowing side, and configured to partially rotate about a horizontal axis, the snow plow blade coupled to a snow plow frame;

a plurality of plow trip spring brackets coupled to the non-plowing side of the snow plow blade;

a plurality of trip springs having first and second ends, with the first ends coupled to the plow trip spring brackets;

a plurality of trip spring brackets, including a plurality of trip spring mounts and a plurality of cushion trip plates, the trip spring brackets coupled to the snow plow frame, the second ends of the trip springs coupled to the trip spring mounts;

a plurality of cushion mounts coupled to the non-plowing side of the snow plow blade and a plurality of cushion blocks coupled to the cushion mounts, wherein the cushion blocks are configured to contact the cushion trip plates to halt the rotation toward the snow plow frame about the horizontal axis of the portion of the snow plow blade above the horizontal axis of rotation.

18. The snow plow of claim 17, wherein the trip springs are configured to draw the top of the snow plow blade toward the snow plow frame around the axis of horizontal rotation when the top of the snow plow blade rotates forward around the horizontal axis of rotation.

19. The snow plow of claim 17, wherein the trip springs are configured to hold the snow plow rotationally in place when the blade is plowing snow.

20. The snow plow of claim 17, wherein the trip springs are configured to absorb a shock which may tend to rotate the top of the snow plow forward, away from the snow plow frame, around the horizontal axis of rotation.

21. The snow plow of claim 17, wherein the cushion trip plates define at least one oversize bolt aperture.

22. The snow plow of claim 17, wherein the cushion blocks are positioned between the snow plow blade and the snow plow frame;

the cushion blocks are configured to prevent the snow plow blade from contacting the snow plow frame or the snow plow mounting apparatus; and the cushion blocks are configured to absorb the force of the snow plow blade travelling toward the snow plow frame and the snow plow mounting apparatus.

23. The snow plow of claim 17, wherein the cushion blocks are configured to prevent damage to the snow plow blade, the snow plow frame, and the apparatus for connecting the snow plow to a vehicle.

24. The snow plow of claim 17, wherein each cushion block is rectangular in shape and composed of a high density resilient material.

25. The snow plow of claim 24, wherein the high density matter is polyurethane.

26. The snow plow of claim 17, wherein each cushion block is configured to be removed and replaced while the snow plow blade is coupled to the snow plow frame and the snow plow frame is coupled to the snow plow mounting apparatus.

27. A method of installing a cushion block in a snow plow apparatus, the snow plow apparatus including a swing frame and a plow blade, the swing frame including a cushion trip plate, the cushion trip plate defining at least one cushion bolt aperture, the plow blade including a cushion mount, the method comprising:

rotating the plow blade in a first direction about a horizontal axis;

placing the cushion block between the cushion trip plate and the cushion mount;

rotating the plow blade in a second direction, the second direction being the opposite of the first direction, about the horizontal axis until the cushion trip plate and cushion mount both engage the cushion block; and inserting at least one fastener through the at least one cushion bolt aperture to couple the cushion block to the cushion mount;

wherein the cushion block is installed without removing the plow blade from the swing frame.

28. The method of claim 27, wherein the fastener is a bolt.

29. The method of claim 27, wherein the cushion block is rectangular in shape and composed of a high density resilient material.

30. The method of claim 27, further comprising replacing the cushion block after it wears out, including:

removing the fasteners through the at least one cushion bolt aperture;

rotating the plow blade in the first direction around the horizontal axis;

removing the cushion block;

inserting a new cushion block between the cushion trip plate and the cushion mount;

rotating the plow blade in the second direction, about the horizontal axis until the cushion trip plate and cushion mount both engage the new cushion block; and inserting at least one fastener through the at least one cushion bolt aperture to couple the new cushion block to the cushion mount;

wherein the cushion block is removed and the new cushion block is installed without removing the plow blade from the swing frame.

* * * * *

UNITED STATES PATENT AND TRADEMARK OFFICE

CERTIFICATE OF CORRECTION

PATENT NO. : 7,992,327 B2
APPLICATION NO. : 12/485508
DATED : August 9, 2011
INVENTOR(S) : Robert N. Gamble, II and Mark D. Buckbee It is certified that error appears in the above-identified patent and that said Letters Patent is hereby corrected as shown below:

Column 6, Line 56:
"unshaped" should read --u-shaped--.

Column 11, Line 41:
"unshaped" should read --u-shaped--.

Signed and Sealed this
Fifteenth Day of November, 2011

David J. Kappos

David J. Kappos
*Director of the United States Patent and Trademark Office*